US011403988B2

(12) United States Patent
Cai et al.

(10) Patent No.: US 11,403,988 B2
(45) Date of Patent: Aug. 2, 2022

(54) DISPLAY PANEL, DISPLAY DEVICE, AND COLOR FILTER SUBSTRATE

(71) Applicants: Beijing BOE Optoelectronics Technology Co., Ltd., Beijing (CN); BOE Technology Group Co., Ltd., Beijing (CN)

(72) Inventors: Xiujun Cai, Beijing (CN); Yanchao Zhang, Beijing (CN); Sa Li, Beijing (CN); Dawei Wang, Beijing (CN); Jiaqiang Wang, Beijing (CN); Huan Bao, Beijing (CN); Cuie Wang, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 559 days.

(21) Appl. No.: 16/341,547

(22) PCT Filed: Nov. 6, 2018

(86) PCT No.: PCT/CN2018/114201

§ 371 (c)(1),
(2) Date: Apr. 12, 2019

(87) PCT Pub. No.: WO2019/179125

PCT Pub. Date: Sep. 26, 2019

(65) Prior Publication Data

US 2021/0327333 A1 Oct. 21, 2021

(30) Foreign Application Priority Data

Mar. 19, 2018 (CN) ..... 201810225574.7

(51) Int. Cl.
*G09G 3/20* (2006.01)

(52) U.S. Cl.
CPC ... *G09G 3/2074* (2013.01); *G09G 2300/0452* (2013.01); *G09G 2300/0465* (2013.01)

(58) Field of Classification Search
CPC ..... G09G 3/2074; G09G 2300/0452; G09G 2300/0465
See application file for complete search history.

(56) References Cited

U.S. PATENT DOCUMENTS

2010/0164883 A1* 7/2010 Ahn ..... G06F 3/042 345/173
2010/0289994 A1 11/2010 Nonaka
(Continued)

FOREIGN PATENT DOCUMENTS

CN 101887189 A 11/2010
CN 105511152 A 4/2016
(Continued)

OTHER PUBLICATIONS

International Search Report (including English translation) and Written Opinion of PCT/CN2018/114201, dated Jan. 30, 2019.
(Continued)

*Primary Examiner* — Hang Lin
(74) *Attorney, Agent, or Firm* — Fay Sharpe LLP

(57) ABSTRACT

A display panel, a display device, and a color filter substrate are provided. The profiled edge region of the display panel comprises a plurality of edge pixels. The profiled edge region is provided with a light shielding structure, and the light shielding structure includes a light shielding unit set in one-to-one correspondence with the plurality of edge pixels. Each plurality of edge pixels includes a plurality of sub-pixels arranged side by side in the first direction.

15 Claims, 20 Drawing Sheets

(56) References Cited

U.S. PATENT DOCUMENTS

| | | | | |
|---|---|---|---|---|
| 2017/0125448 | A1* | 5/2017 | Park | H01L 27/3216 |
| 2017/0250377 | A1* | 8/2017 | Tokuda | H01L 27/322 |
| 2018/0151612 | A1 | 5/2018 | Zheng et al. | |
| 2018/0337217 | A1 | 11/2018 | Zang et al. | |
| 2018/0374401 | A1 | 12/2018 | Yang et al. | |

FOREIGN PATENT DOCUMENTS

| | | | |
|---|---|---|---|
| CN | 105911744 | A | 8/2016 |
| CN | 106873224 | A | 6/2017 |
| CN | 106960650 | A | 7/2017 |
| CN | 107255883 | A | 10/2017 |
| CN | 107422516 | A | 12/2017 |
| CN | 107577078 | A | 1/2018 |
| CN | 108364568 | A | 3/2018 |
| KR | 100852414 | B1 | 8/2018 |

OTHER PUBLICATIONS

The First Office Action of the priority Chinese appliation No. 201810225574.7 (including English translation) dated Mar. 21, 2019.

* cited by examiner

DISPLAY PANEL, DISPLAY DEVICE, AND COLOR FILTER SUBSTRATE

This application is a 371 of PCT Patent Application Serial No. PCT/CN2018/114201, filed on Nov. 6, 2018, which claims priority to Chinese Patent Application No. 201810225574.7, filed on Mar. 19, 2018 and entitled "DISPLAY PANEL, DISPLAY DEVICE, AND COLOR FILTER SUBSTRATE", the entire contents of which are incorporated herein by reference.

TECHNICAL FIELD

The present disclosure relates to a display panel, a display device, and a color filter substrate.

BACKGROUND

With the rapid development of display technology, various irregularly shaped display panels are widely applied in electronic devices. An irregularly shaped display panel refers to a display panel having a non-rectangular display area, such as a circular display area, a sector display area, etc.

For a display panel having a non-rectangular display area, at the profiled edge of the non-rectangular display area, the pixels are arranged along the boundary line at the profiled edge to better match the boundary line at the profiled edge.

SUMMARY

Embodiments of the present disclosure provide a display panel, a display device, and a color filter substrate.

At least one embodiment of the present disclosure provides a display panel, comprising: a display area and a non-display area adjacent to the display area, wherein the display area comprises at least one profiled edge region, each profiled edge region comprises a plurality of edge pixels, the display panel further comprises a light shielding structure in the profiled edge region, and the light shielding structure comprises light shielding units in one-to-one correspondence to the edge pixels.

Each edge pixel comprises a plurality of sub-pixels arranged side by side in a first direction, an orthographic projection of the light shielding unit on each sub-pixel covers a first end of a corresponding sub-pixel, the first end is an end close to the non-display area in a second direction, a boundary line between the orthographic projection of the light shielding unit on one sub-pixel and the corresponding sub-pixel is an arc, and the second direction is perpendicular to the first direction.

Here, the first direction may be one of a pixel row direction and a pixel column direction.

Optionally, the boundary line is concave to the non-display area along the second direction.

Optionally, the profiled edge region comprises a plurality of pixel groups arranged in a staircase manner, and the plurality of pixel groups comprise at least one of a first pixel group, a second pixel group, and a third pixel group.

The first pixel group comprises at least two edge pixels in the same pixel column, the second pixel group comprises at least two edge pixels in the same pixel row, and the third pixel group comprises one edge pixel.

In the second direction, a shielding area $S_1$ of the light shielding unit of the edge pixel in the first pixel group decrease by equal difference in a direction away from the non-display area, where $0<S_1<S_B$, and in the first direction, a shielding area $S_2$ of the light shielding unit of the edge pixel in the second pixel group decreases by equal difference in a direction away from the non-display area, where $0<S_2<S_B$, and $S_B$ is the area of each edge pixel.

Optionally, in the pixel row direction, a shielding area of the light shielding unit of two adjacent edge pixels in the second pixel group satisfies the following condition: $10\% \leq |S_{2a}-S_{2b}|/S_B \leq 30\%$. In the embodiments of the present disclosure, $S_{2a}$ and $S_{2b}$ are shielding areas of the light shielding units of two adjacent edge pixels in the second pixel group in the first direction, respectively.

Optionally, in the second direction, a shielding area of the light shielding unit of two adjacent edge pixels in the first pixel group satisfies the following condition: $10\% \leq |S_{1c}-S_{1d}|/S_B \leq 30\%$. In the embodiments of the present disclosure, $S_{1c}$ and $S_{1d}$ are shielding areas of the light shielding units of the two adjacent edge pixels in the first pixel group in the second direction, respectively.

Optionally, a difference in a shielding area of the light shielding unit of the outermost pixel of the two adjacent pixel groups among the plurality of pixel groups satisfies the following condition: $10\% \leq S_m-S_n|/S_B \leq 30\%$. In the embodiments of the present disclosure, $S_m$ and $S_n$ are shielding areas of the light shielding units of the outermost pixels of the two adjacent pixel groups of the plurality of pixel groups respectively, the outermost pixel of the first pixel group is the edge pixel closest to the non-display area in the second direction, the outermost pixel of the second pixel group is the edge pixel closest to the non-display area in the first direction, and the one edge pixel of the third pixel group is the outermost pixel.

Optionally, the display panel further comprises a black matrix, and the light shielding structure is a black matrix.

Optionally, the display panel comprises an array substrate and a color filter substrate facing the array substrate, and the black matrix is located on the color filter substrate.

Optionally, the light shielding unit has the same shielding area on the plurality of sub-pixels in the same edge pixel.

Optionally, a boundary line of the profiled edge region is an arc convex to the non-display area or an arc convex to the display area.

Optionally, the display area is a sector, an arc, a circle, a rounded rectangle, or a polygon.

At least one embodiment of the present disclosure provides a display device, comprising any of the display panels described in the first aspect.

At least one embodiment of the present disclosure provides a color filter substrate, comprising: a display area and a non-display area adjacent to the display area, wherein the display area comprises at least one profiled edge region, each profiled edge region comprises a plurality of edge pixel regions, the color filter substrate further comprises a light shielding structure of the profiled edge region, and the light shielding structure comprises light shielding units in one-to-one correspondence to the edge pixel regions.

Each edge pixel region comprises a plurality of sub-pixel regions arranged side by side in a first direction, and an orthographic projection of the light shielding unit on each sub-pixel region covers a first end of a corresponding sub-pixel region, the first end is an end close to the non-display area in the second direction, a boundary line between the orthographic projection of the light shielding unit on one sub-pixel region and the corresponding sub-pixel region is an arc, and the second direction is perpendicular to the first direction.

Further, a boundary line is concave to the non-display region in the second direction.

Further, the profiled edge region comprises a plurality of pixel region groups arranged in a staircase manner and the plurality of pixel region groups comprises at least one of a first pixel region group, a second pixel region group, and a third pixel region group.

The first pixel region group comprises at least two edge pixel regions in a column of the same pixel region, the second pixel region group comprises at least two edge pixel regions in a row of the same pixel region along the pixel row direction, and the third pixel region group comprises one edge pixel region.

In the pixel column direction, a shielding area $S_1$ of the light shielding unit of the edge pixel region in the first pixel region group decreases by equal difference in a direction away from the non-display area, where $0<S_1<S_B$, and in the pixel row direction, the shielding area $S_2$ of the light shielding unit of the edge pixel region in the second pixel region group decreases by equal difference in a direction away from the non-display area, where $0<S_2<S_B$, and $S_B$ is an area of each edge pixel region.

DETAILED DESCRIPTION

To make the principles and advantages of the present disclosure clearer, the embodiments of the present disclosure will be described below in detail in conjunction with the accompanying drawings.

However, since each pixel in the display panel includes a plurality of sub-pixels and the sub-pixels are rectangular, the sub-pixels at the profiled edge and the boundary line at the profiled edge cannot be completely matched and there are saw toothed gullets, resulting in that the displayed image has saw teeth at the profiled edge of the display area and affecting the visual effect of the irregularly shaped display panel.

Figure 1:
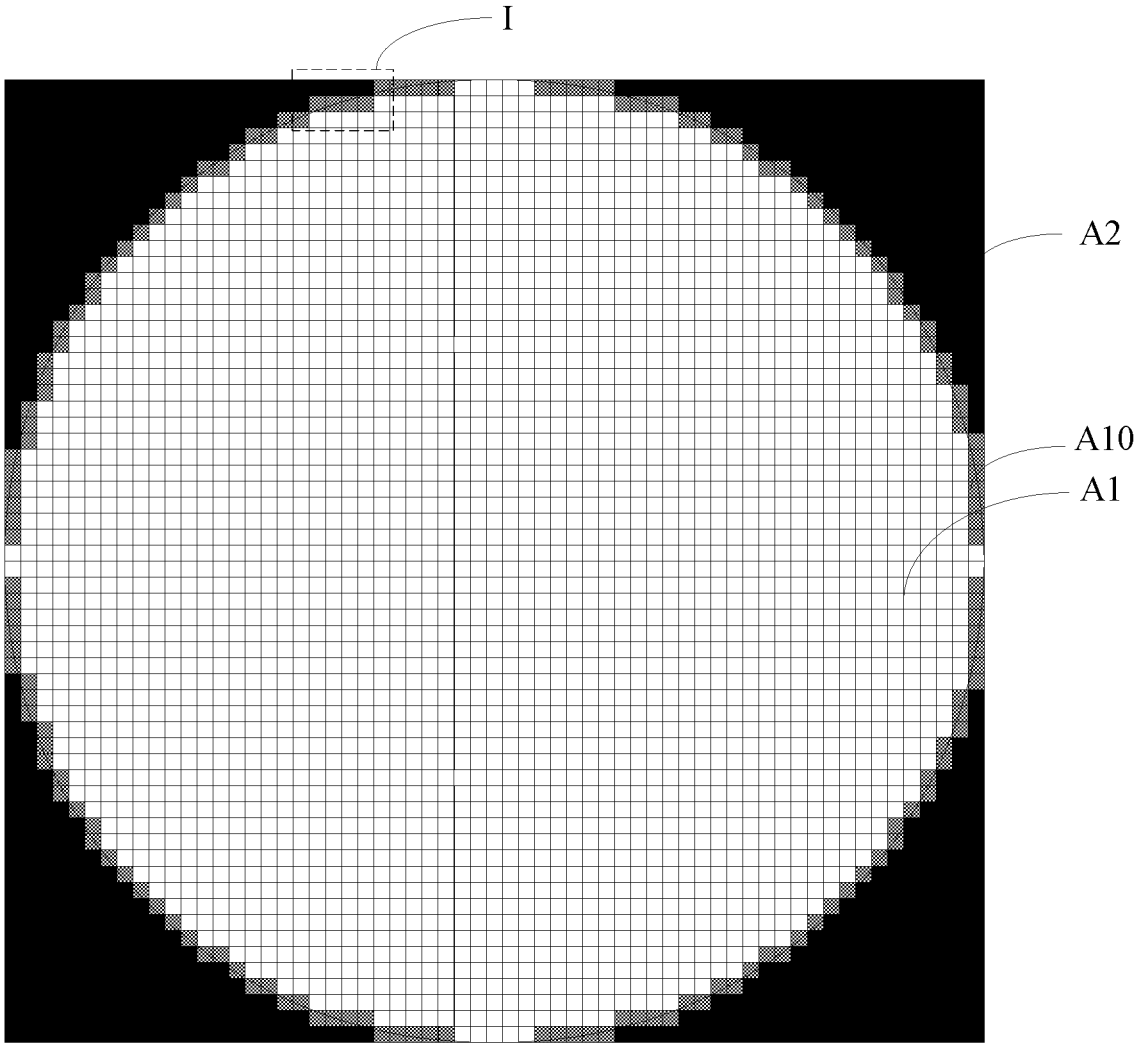
FIG. 1 is a schematic structural diagram of a display panel according to an embodiment of the present disclosure.

FIG. 1 is a schematic structural diagram of a display panel according to an embodiment of the present disclosure. As shown in FIG. 1, an embodiment of the present disclosure provides a display panel including a display area A1 and a non-display area A2 adjacent to the display area A1. The non-display area A2 is set around the display area A1. The display area A1 includes a plurality of pixels arranged in an array. The display area A1 includes at least one profiled edge area A10.

It is to be noted that, in the embodiment of the present disclosure, the profiled edge region A10 refers to a region in which the boundary line of the display area A1 and the non-display area A2 are not arranged in the pixel row direction or the pixel column direction. The edge pixel refers to a pixel adjacent to the non-display area A2. The edge pixel includes a plurality of edge pixels located in the profiled edge region A10.

In the embodiment shown in FIG. 1, the boundary line of the display area A1 of the display panel is a circle. The display panel has four profiled edge regions A10, and the profiled edge region A10 shown in FIG. 1 is shaded in gray. The four profiled edge regions A10 are spaced apart from each other. The four profiled edge regions A10 respectively include a first profiled edge region located in the upper left corner of FIG. 1, a second profiled edge region located in the upper right corner of FIG. 1, a third profiled edge region located at the lower left corner of FIG. 1, and a fourth profiled edge region located at a lower right corner of FIG. 1.

The display panel further includes a light shielding structure set in the profiled edge region A10. The light shielding structure includes light shielding units in one-to-one correspondence with the edge pixels.

Figure 2:
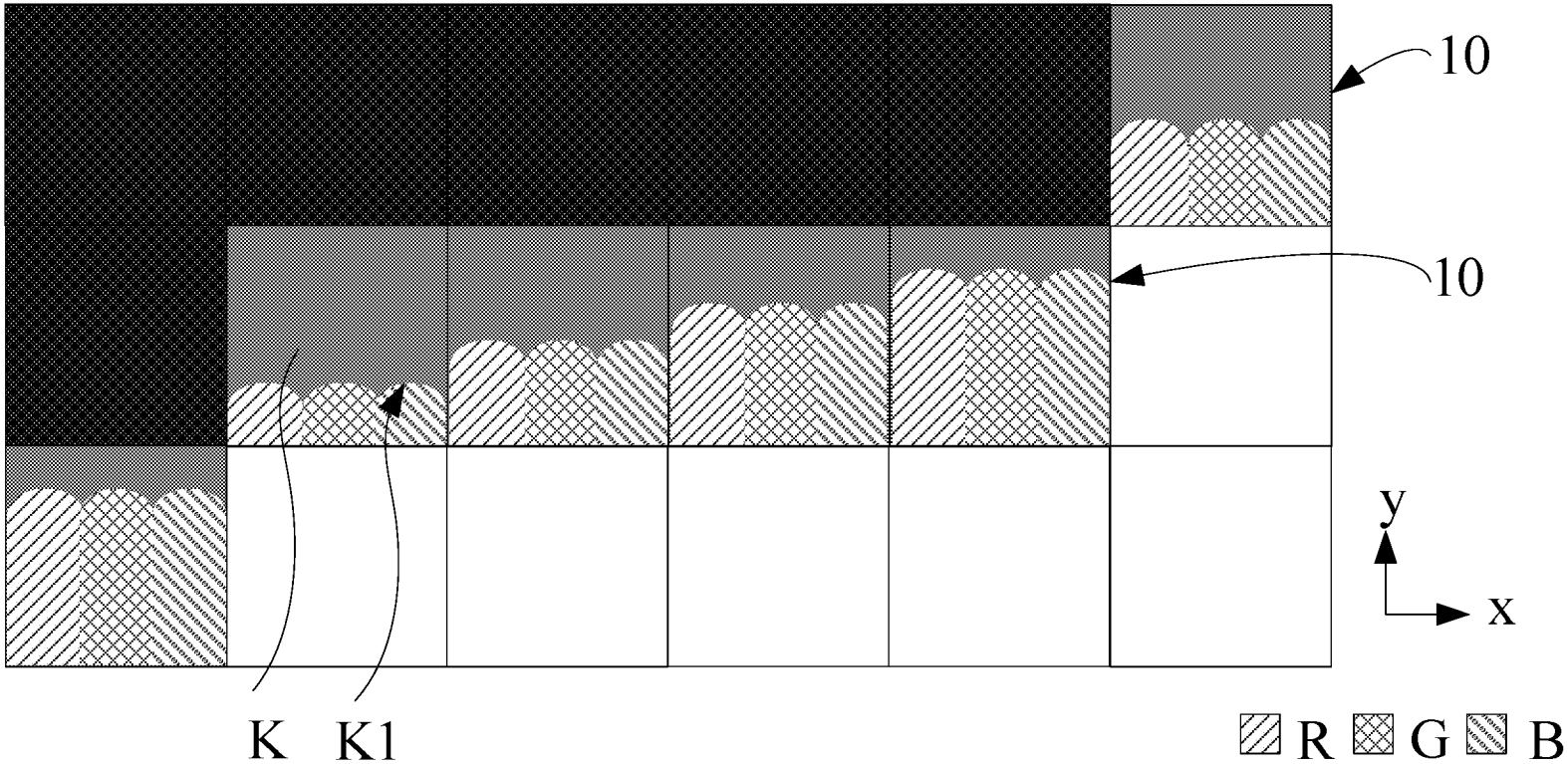
FIG. 2 is an enlarged schematic view of an area I of FIG. 1.

FIG. 2 is an enlarged schematic view of a region I of FIG. 1. As shown in FIG. 1 and FIG. 2, each rectangular block in FIGS. 1 and 2 represents one pixel. The pixel includes an edge pixel 10 and a non-edge pixel. The black portion in the figure represents the non-display area A2 and the white rectangular block represents the non-edge pixel in the display area A1. The shaded rectangular block represents the edge pixel 10 located in the profiled edge region A10. The sub-pixel in the non-edge pixel is arranged in the same manner as the sub-pixel in the edge pixel 10. Each edge pixel 10 may include three sub-pixels—a red sub-pixel R, a green sub-pixel G, and a blue sub-pixel B, and the three sub-pixels are arranged in a pixel row direction (i.e., the x direction in FIG. 2). The orthographic projection of the light shielding unit K on each sub-pixel covers an end of the corresponding sub-pixel adjacent to the non-display area A2 in the pixel column direction (i.e., the y direction in FIG. 2), The boundary line K1 between the orthographic projection of the light shielding unit K on one sub-pixel and the corresponding sub-pixel is an arc.

Optionally, a black matrix is set between two sub-pixels. The black matrix between two sub-pixels is not shown in FIG. 2 and FIG. 7, FIG. 8, FIG. 9, FIG. 10, FIG. 11, or FIG. 12.

Embodiments of the present disclosure provide a light shielding structure in a profiled edge region of a display panel. The light shielding structure includes light shielding units set in one-to-one correspondence with the edge pixels. Each edge pixel includes a plurality of sub-pixels and the shielding area of the plurality of sub-pixels of the same edge pixel is equal. That is, in the same edge pixel, the light-emitting area of each sub-pixel is equal, which can prevent the color shift phenomenon from happening in the pixel. In addition, the orthographic projection of the light shielding unit on each sub-pixel covers an end of the corresponding sub-pixel close to the non-display area in the pixel column direction. The boundary line between the orthographic projection and the corresponding sub-pixel is an arc. That is, one end of each sub-pixel close to the non-display area in the pixel column direction is an arc, for example, a semicircle. The arcuate design can make the weakening effect of the saw tooth of the profiled edge region more obvious, reduce the edge saw tooth effect of the display panel, and improve the display effect of the irregularly-shaped display panel, so that the saw teeth of the profiled edge region which can be perceived by human eyes are no longer obvious.

As shown in FIG. 2, the shielding area of the light shielding unit K on the plurality of sub-pixels of the same edge pixel is equal. The shielding area of the light shielding unit on the plurality of sub-pixels of the same edge pixel is equal. The orthographic projection of the light shielding unit on each sub-pixel covers an end of the corresponding sub-pixel close to the non-display area in the pixel column direction, for the convenience of design and production of the light shielding unit.

As shown in FIG. 1 and FIG. 2, in an implementation of the embodiment of the present disclosure, the boundary line K1 between the orthographic projection and the corresponding sub-pixel is concave toward the non-display area A2 along the pixel column direction. The boundary line K1 between the orthographic projection and the corresponding sub-pixel is an arc that curves toward the non-display area, that is, one end of each sub-pixel close to the non-display area in the pixel column direction is a convex arc.

Figure 3:
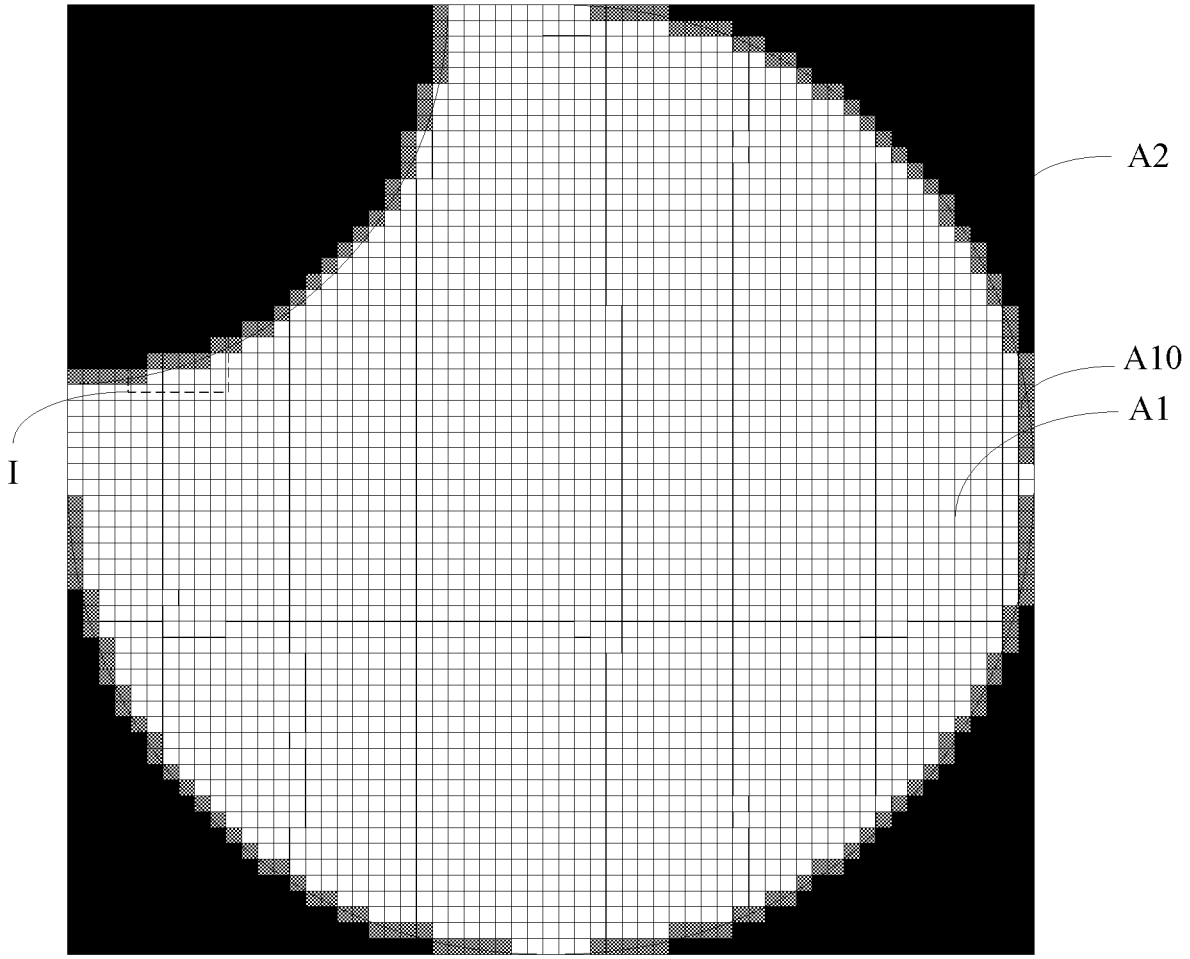
FIG. 3 is a schematic structural diagram of another display panel according to an embodiment of the present disclosure.

FIG. 3 is a schematic structural diagram of another display panel according to an embodiment of the present disclosure. In the embodiment shown in FIG. 3, the boundary line of the display area A1 of the display panel includes a convex arc portion and a concave arc portion. The light shielding structure of the convex arc portion can be set by following the scheme shown in FIG. 2. The light shielding structure of the concave arc portion is set by following the scheme shown in FIG. 4.

Figure 4:
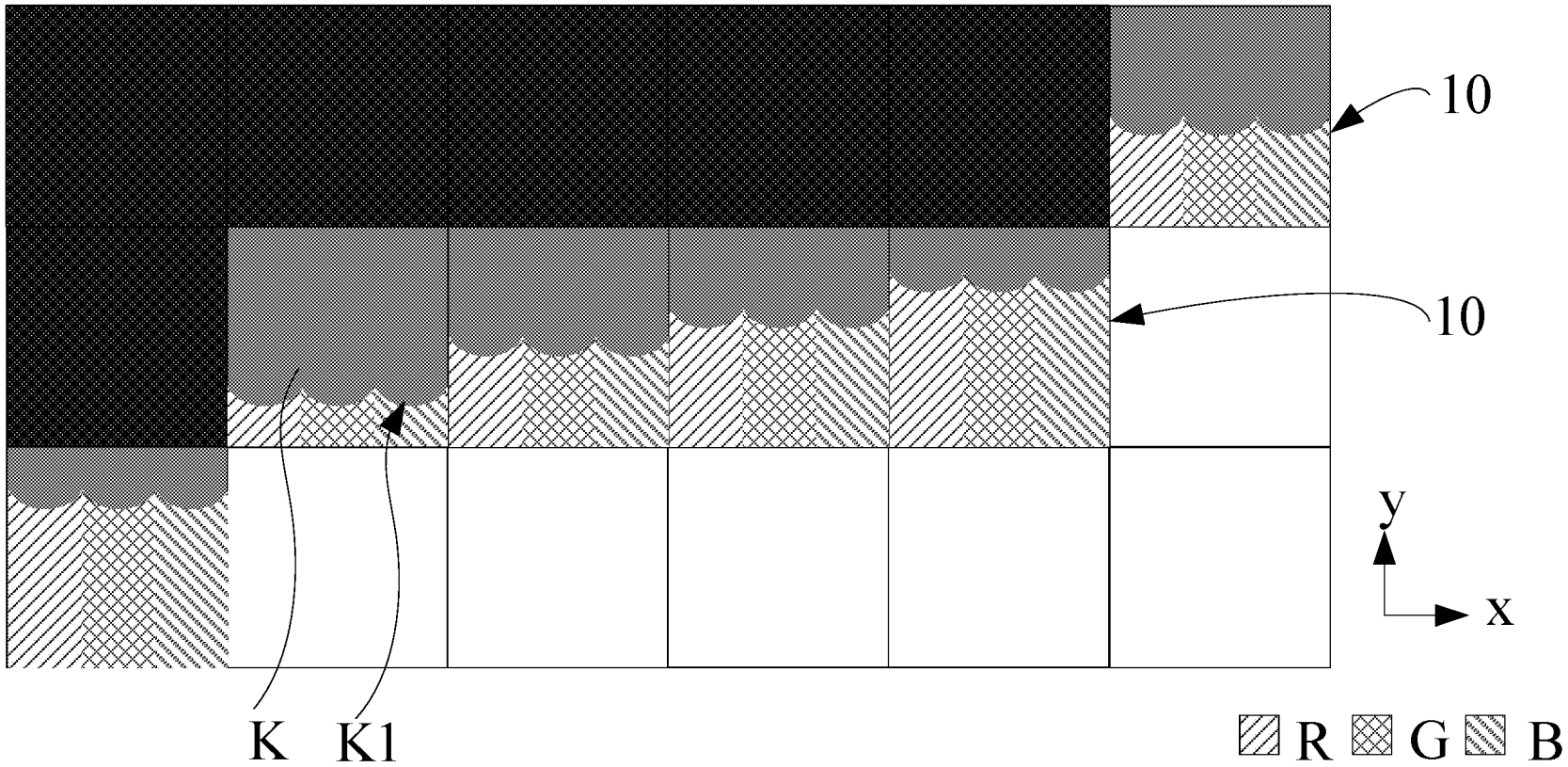
FIG. 4 is another enlarged schematic view of the area I of FIG. 3.

FIG. 4 is another enlarged schematic view of the area I of FIG. 3. As shown in FIG. 1 and FIG. 4, in another implementation of the embodiment of the present disclosure, the boundary line K1 between the orthographic projection and the corresponding sub-pixel is concave to the display area A1 along the pixel column direction. The boundary line K1 between the orthographic projection and the corresponding sub-pixel is an arc that curves to the display area, that is, one end of each sub-pixel close to the display area in the pixel column direction is a convex arc.

That is, when the boundary line of the display area A1 is convex, the boundary line K1 between the orthographic projection and the corresponding sub-pixel is an arc that curves to the non-display area. When the boundary line K1 of the display area A1 is concave, the boundary line between the orthographic projection and the corresponding sub-pixel is an arc that concave toward the display area.

Figure 5:
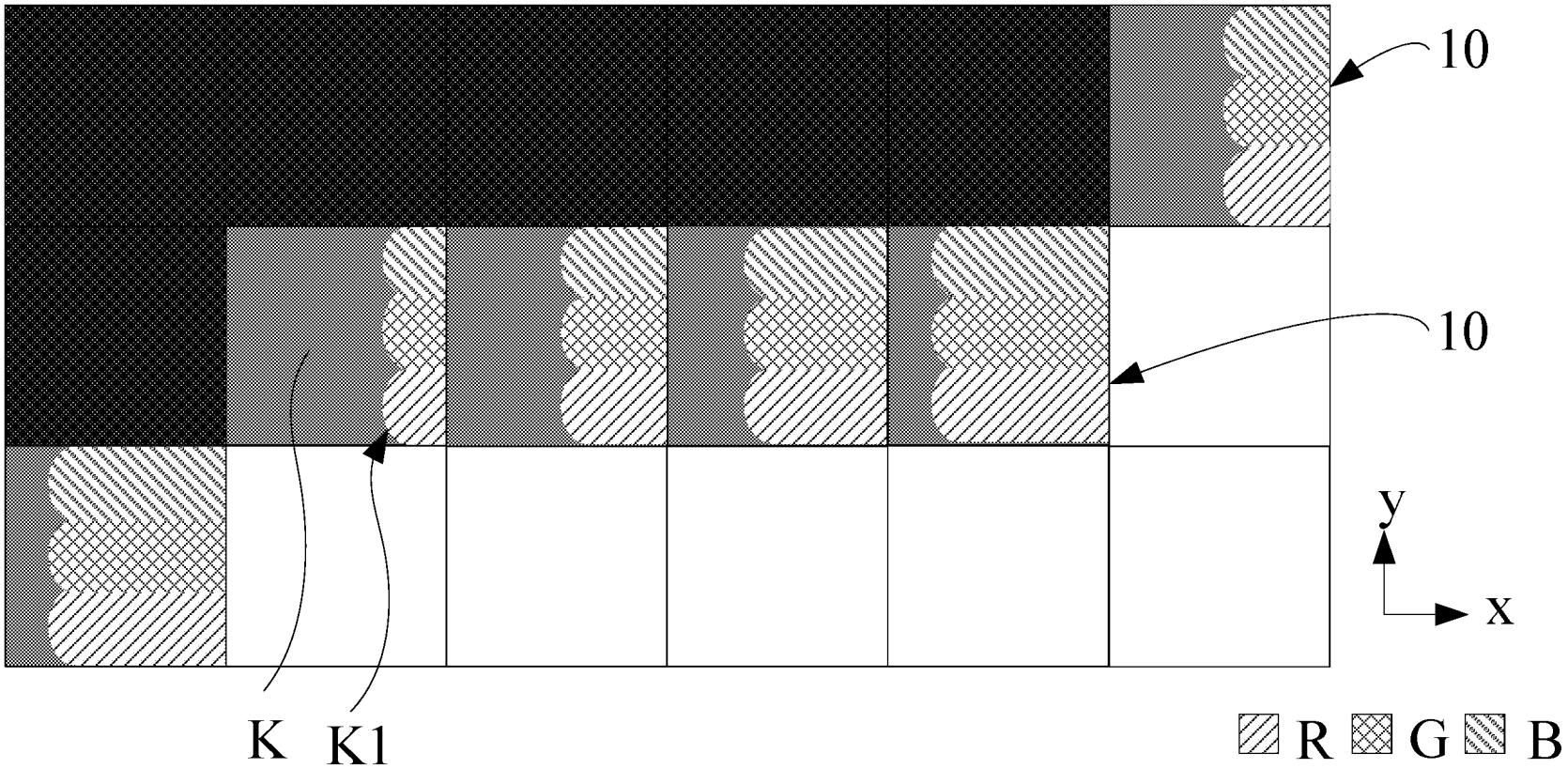
FIG. 5 is another enlarged schematic view of the area I of FIG. 1.

FIG. 5 is another enlarged schematic view of a region I of FIG. 1. The pixel structure shown in FIG. 5 is different from that of FIG. 2 in that three sub-pixels are arranged in the pixel column direction (i.e., the y direction in FIG. 5). The orthographic projection of the light-shielding unit K on each sub-pixel covers one end of the corresponding sub-pixel close to the non-display area A2 in the pixel row direction (i.e., the x direction in FIG. 2).

In the structure shown in FIG. 5, the boundary line between the orthographic projection and the corresponding sub-pixel is recessed toward the non-display area A2 along the pixel row direction.

That is, in the pixel structure illustrated in FIGS. 2, 4, and 5, each edge pixel includes a plurality of sub-pixels arranged side by side in the first direction. The orthographic projection of the light shielding unit on each sub-pixel covers the first end of the corresponding sub-pixel. The first end is an end close to the non-display area in the second direction. The first direction is either a pixel row direction or a pixel column direction and the second direction is perpendicular to the first direction.

It should be noted that, in other embodiments of the present disclosure, each edge pixel is not limited to be composed of three sub-pixels of R, G, and B as shown in FIG. 2 and FIG. 5, for example, may be composed of four sub-pixels of red, green, blue, and white. Meanwhile, the arrangement of each sub-pixel in each edge pixel is not limited to the arrangement structure in FIG. 2, and other arrangement structures may also be employed.

Exemplarily, in this embodiment, each light shielding unit is located on a light emitting side of the corresponding edge pixel.

The structure of the display panel provided by the present disclosure will be further described below by taking the pixel structure shown in FIG. 2 as an example, referring to FIG. 6 to FIG. 20 subsequently.

Figure 6:
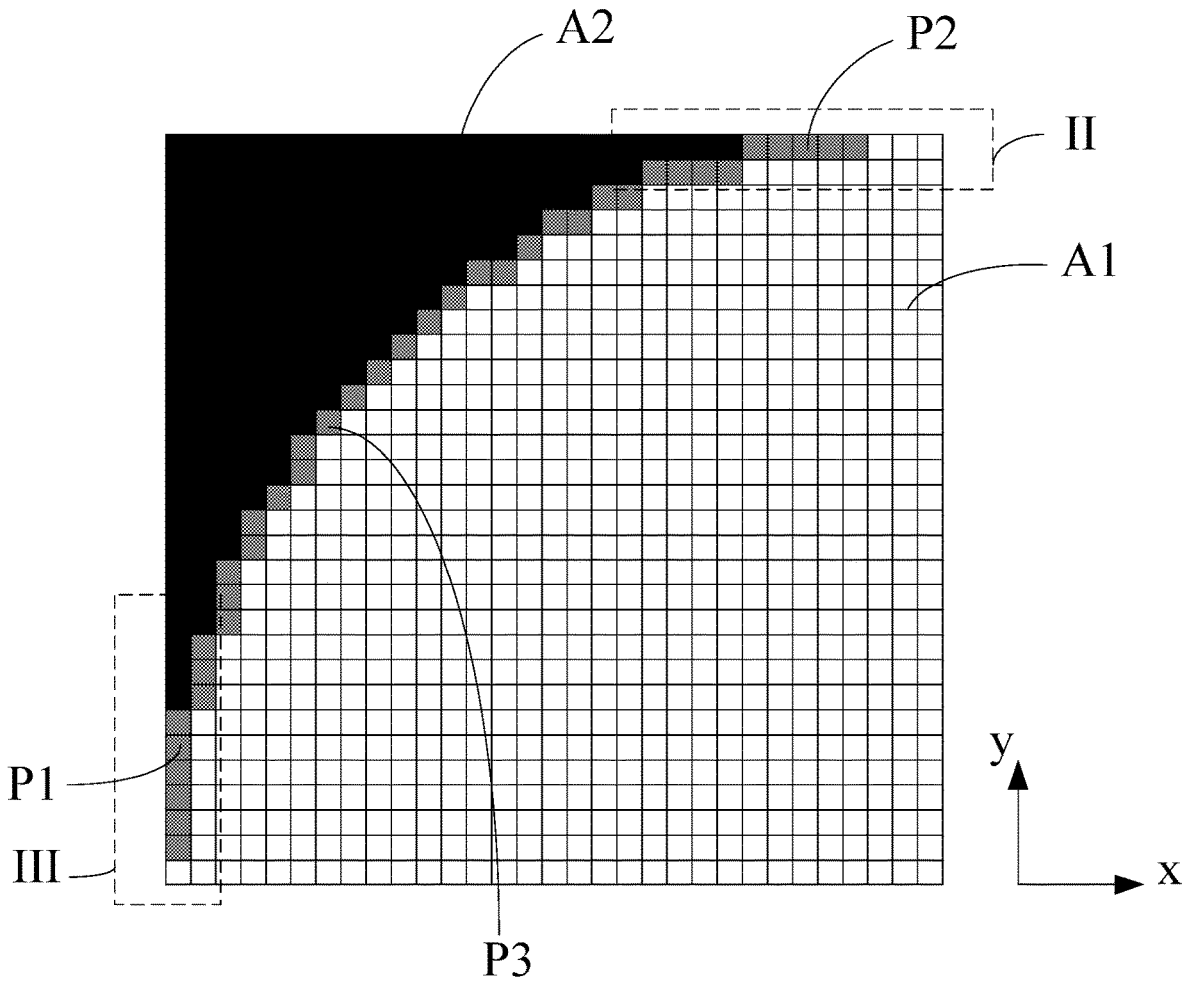
FIG. 6 is a partial enlarged view of FIG. 1.

FIG. 6 is a partial enlarged view of FIG. 1. As shown in FIG. 6, FIG. 6 is a top left corner area of FIG. 1, a plurality of edge pixels in the profiled edge region A10 forms a plurality of pixel groups arranged in a staircase manner, that is, the profiled edge region A10 includes a plurality of pixel groups arranged in a staircase manner. The plurality of pixel groups includes at least one of a first pixel group P1, a second pixel group P2, and a third pixel group P3. The first pixel group P1 includes at least two edge pixels set in the same pixel column along the pixel column direction (i.e., the y direction in FIG. 6), the second pixel group P2 includes at least two edge pixels set in the same pixel row along a pixel row direction (i.e., the x direction in FIG. 6), and the third pixel group P3 includes one edge pixel. As the plurality of pixel groups are arranged in a staircase manner, the edge pixel in the third pixel group P3 does not have adjacent pixels in both the pixel row direction and the pixel column direction.

In the present embodiment, the display panel has four profiled edge regions A10, which are symmetrically arranged. FIG. 6 includes one of the four profiled edge regions A10 in FIG. 1. The profiled edge region A10 includes five first pixel groups P1, five second pixel groups P2, and eight third pixel groups P3.

In the pixel column direction, the shielding area S1 of the light shielding unit of the edge pixel in the first pixel group P1 decreases by equal difference in the direction away from the non-display area A2, where $0<S1<SB$. In the pixel row direction, the shielding area S2 of the light shielding unit of the edge pixel in the second pixel group P2 decreases by equal difference along the direction away from the non-display area A2, where 0<S2<SB, and SB is the area of each edge pixel. In this way, the brightness can transit smoothly from bright in the display area to dark in the non-display in the display panel and the edge is displayed in a smooth manner, thereby reducing the edge saw tooth effect of the display panel, and improving the display effect of the profiled display panel. Thus, the saw teeth of the profiled edge region perceived by human eyes are no longer obvious.

Further, the difference between the shielding area, that decreases by equal difference, of the light shielding unit of the outermost pixel of the two adjacent pixel groups in the plurality of pixel groups satisfies the following conditions:

$$10\% \leq |S_m - S_n|/S_B \leq 30\%;$$

In the embodiment of the present disclosure, $S_m$, and $S_n$ are shielding areas of the light shielding units of the outermost pixels of the two adjacent pixel groups in the plurality of pixel groups respectively. The outermost pixel of the first pixel group P1 is the edge pixel closest to the non-display area A2 in the pixel column direction. The outermost pixel of the second pixel group P2 is the edge pixel closest to the non-display area A2 in the pixel row direction. One edge pixel in the third pixel group P3 is the outermost pixel. By setting the shielding area difference between the light shielding unit of the outermost pixel of the two adjacent pixel groups in the plurality of pixel groups, it can be ensured that the brightness difference of the adjacent pixel groups will not be too large, so that the brightness can transit smoothly from bright in the display area to dark in non-display in the display panel.

Figure 7:
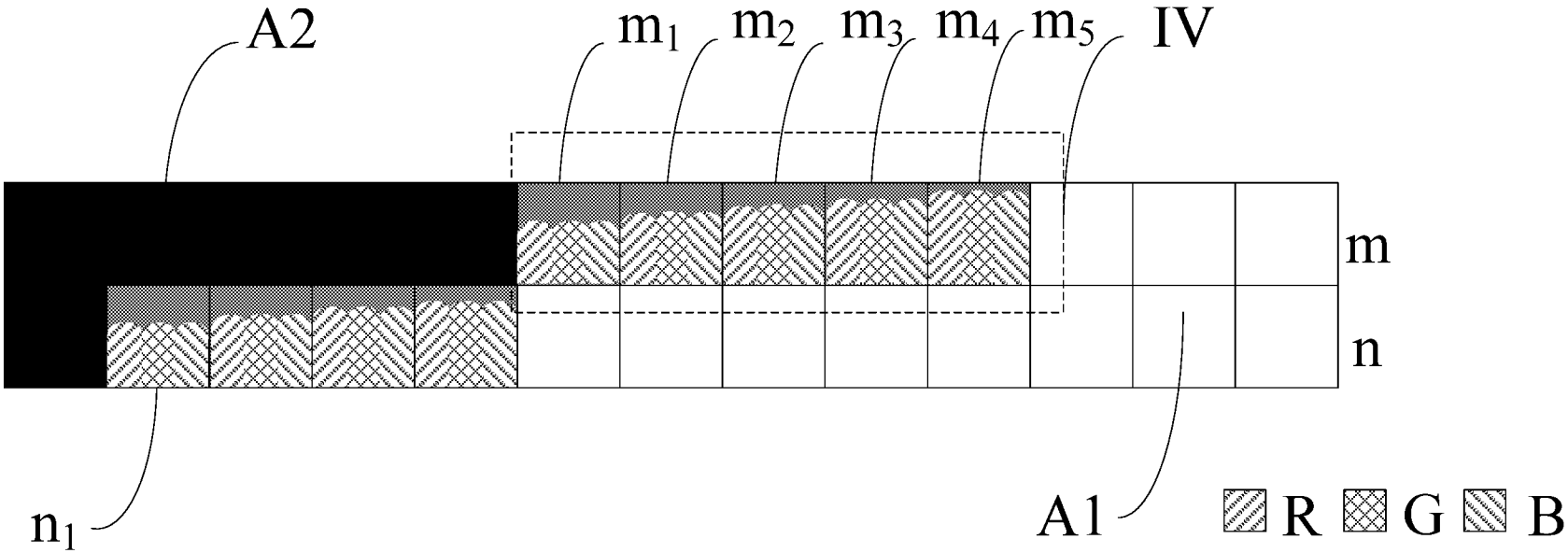
FIG. 7 is an enlarged schematic view of the area II of FIG. 6.

FIG. 7 is an enlarged schematic view of a region II of FIG. 6. As shown in FIG. 7, the figure includes two adjacent second pixel groups P2. The second pixel group P2 located in the m-th row includes five edge pixels m1, m2, m3, m4, and m5. The edge pixel m1 among the five edge pixels closest to the non-display area A2 is the outermost pixel. The shielding area of the light shielding unit of the outermost pixel m1 is Sm1, and the second pixel group P2 located in the n-th row includes four edge pixels. The edge pixel n1 among the four edge pixels closest to the non-display area A2 is the outermost pixel. The edge pixel among the four edge pixels closest to the non-display area A2 is the leftmost edge pixel n1. The two sides of the edge pixel n1 are close to the non-display area A2. The shielding area of the light shielding unit n1 of the rightmost pixel is Sn1. The difference between the shielding area of the light shielding unit of the outermost pixel m1 and the outermost pixel n1 satisfies: 10%≤|Sm1−Sn1|/SB≤30%.

Figure 8:
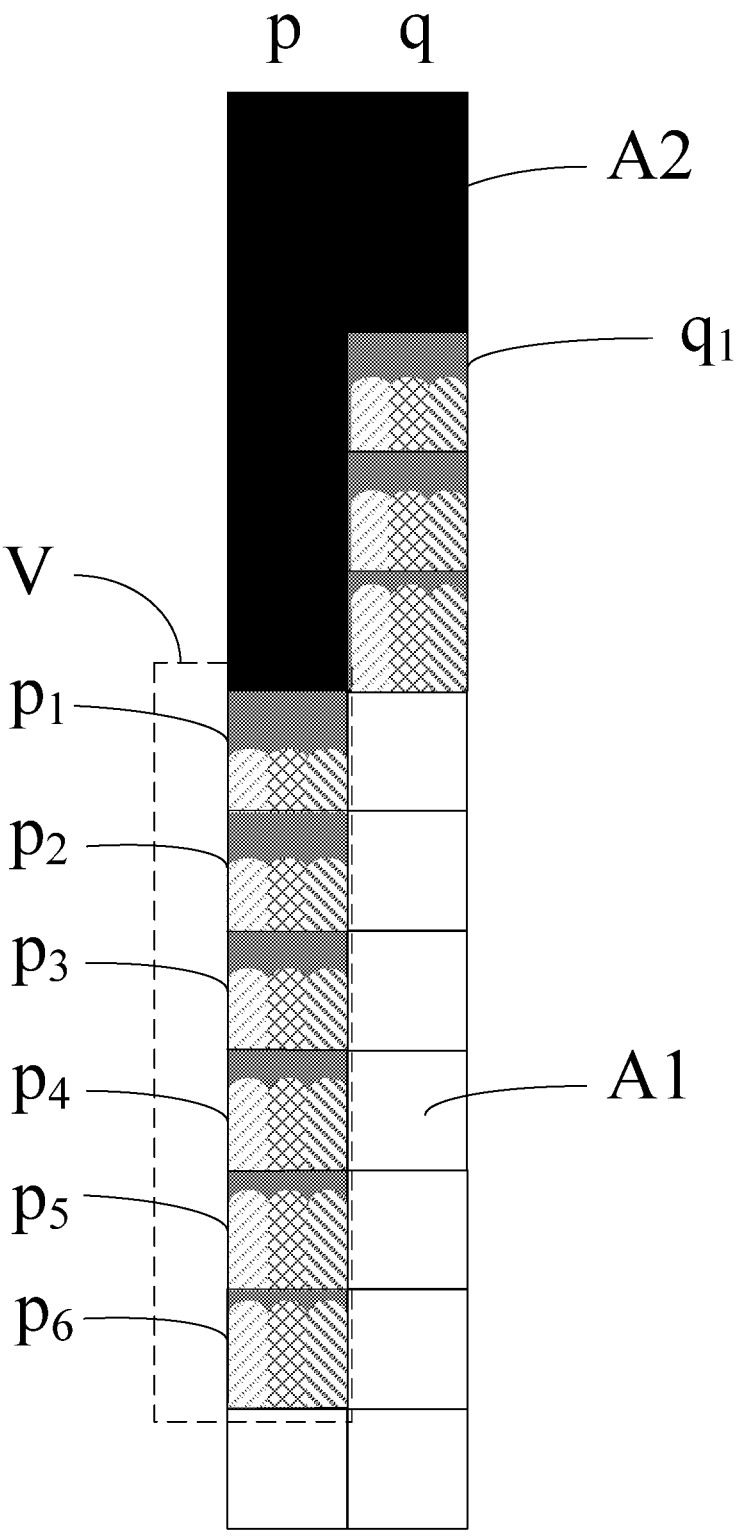
FIG. 8 is an enlarged schematic view of the area III of FIG. 6.

FIG. 8 is an enlarged schematic view of a region III of FIG. 6. As shown in FIG. 8, the figure includes two adjacent first pixel groups P1 and the first pixel group P1 located in the p-th column includes six edge pixels p1, p2, p3, p4, p5, and p6. The edge pixel p1 closest to the non-display area A2 among the six edge pixels is the outermost pixel. The shielding area of the light shielding unit of the outermost pixel p1 is Sp1 and the first pixel group P1 located in the q-th column includes three edge pixels. The edge pixel q1 closest to the non-display area A2 among the three edge pixels is the outermost pixel. The edge pixel closest to the non-display area A2 among the three edge pixels is the uppermost edge pixel q1, and the two sides of the edge pixel q1 are close to the non-display area A2. The shielding area of the light shielding unit of the outermost pixel q1 is Sq1, and the difference of the shielding areas of the light shielding units between the outermost pixel p1 and the outermost pixel q1 satisfies: 10%≤|Sp1−Sq1|/SB≤30%.

Further, in the pixel row direction, the shielding area of the light shielding unit of the two adjacent edge pixels in the second pixel group P2 satisfies the following condition: $10\% \leq |S_{2a} - S_{2b}|/S_B \leq 30\%$.

In the embodiment of the present disclosure, $S_{2a}$ and $S_{2b}$ are the shielding areas of the light shielding units of the two adjacent edge pixels m the second pixel group P2 in the pixel row direction respectively. In the pixel row direction, the difference of the shielding areas S2 of the light shielding units between the adjacent edge pixels in the second pixel group P2 is within a set range to ensure that the brightness difference of the edge pixels of the same row is not too large and realize a smooth brightness transition from bright in the display area A1 to dark in the non-display area A2 in the display panel.

Figure 9:
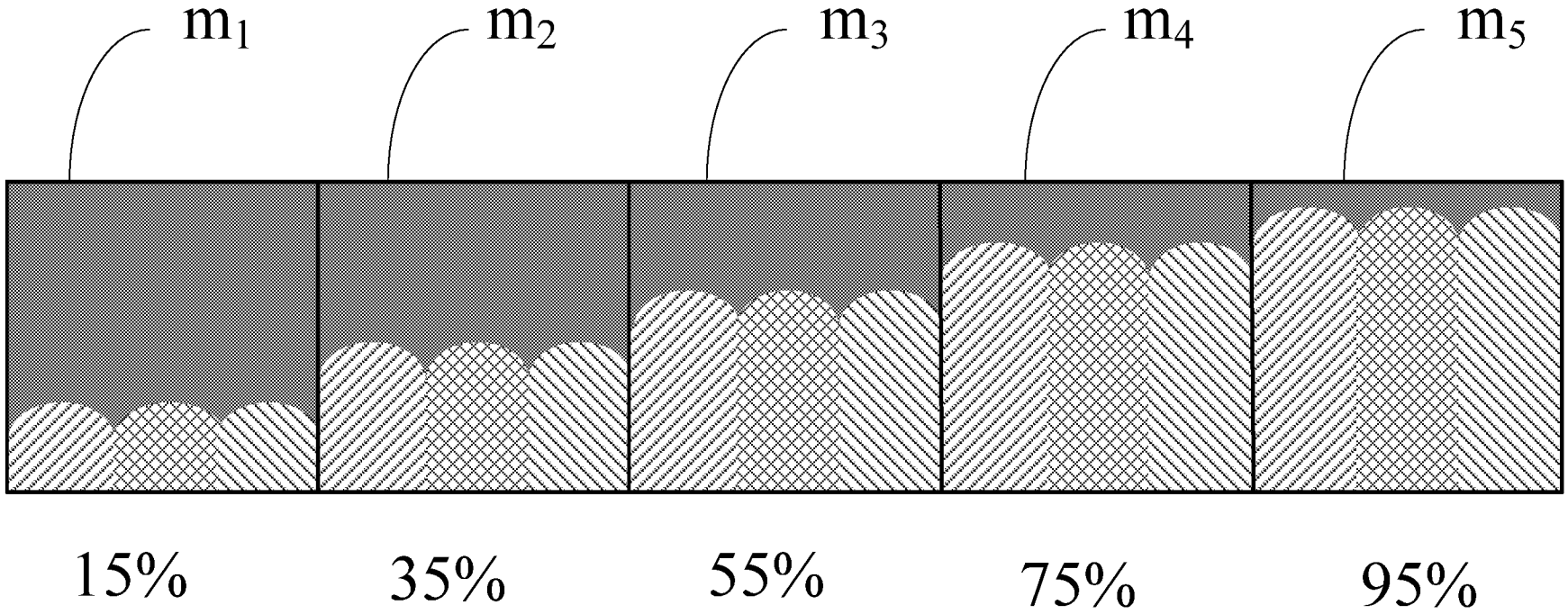
FIG. 9 is an enlarged schematic view of the area IV of FIG. 7.

FIG. 9 is an enlarged schematic view of a region IV of FIG. 7. As shown in FIG. 9, in the m-th row of pixels, the second pixel group P2 includes five edge pixels m1, m2, m3, m4, and m5. Each edge pixel is provided with a light shielding unit, and the percentage in FIG. 9 represents a ratio of an unshielded pixel area. The unshielded pixel area ratio represents a percentage ratio of the pixel area that is not shielded by the light shielding unit in each edge pixel to the area of the edge pixel. In the present embodiment, the unshielded pixel area ratios of the edge pixels m1, m2, m3, m4, and m5 are sequentially 15%, 35%, 55%, 75%, and 95%. Then, for the two adjacent edge pixels, for example, the ratio of the shielding area S21 of the light shielding unit of the edge pixel m1 to the area. SB of the edge pixel m1 is 85%. The ratio of the shielding area. S22 of the light shielding unit of the edge pixel m2 to the area SB of the edge pixel m2 is 65%, 85%-65%=20%, satisfying 10%≤|S21−S22|/SB≤30%.

Figure 10:
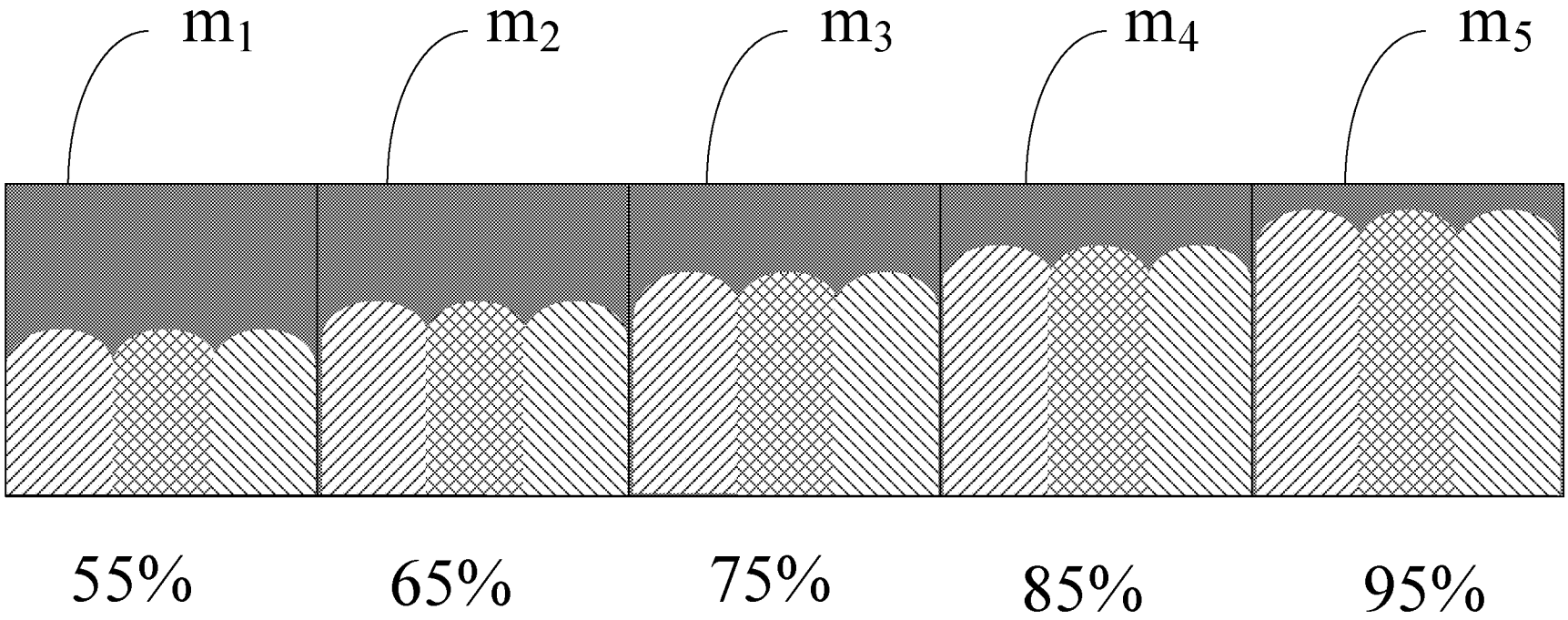
FIG. 10 is another enlarged schematic view of the area IV of FIG. 7.

FIG. 10 is another enlarged schematic view of a region IV of FIG. 7. As shown in FIG. 10, in the present embodiment, the unshielded pixel area ratios of the edge pixels m1, m2, m3, m4, and m5 are sequentially 55%, 65%, 75%, 85%, and 95%. Then, for the two adjacent edge pixels, for example, the ratio of the shielding area S21 of the light shielding unit of the edge pixel m1 to the area SB of the edge pixel m1 is 45%. The ratio of shielding area S22 of the light shielding unit of the edge pixel m2 to the area SB of the edge pixel m2 is 35%, 45%-35%=10%, satisfying 10%≤|S21−S22|/SB≤30%.

Figure 11:
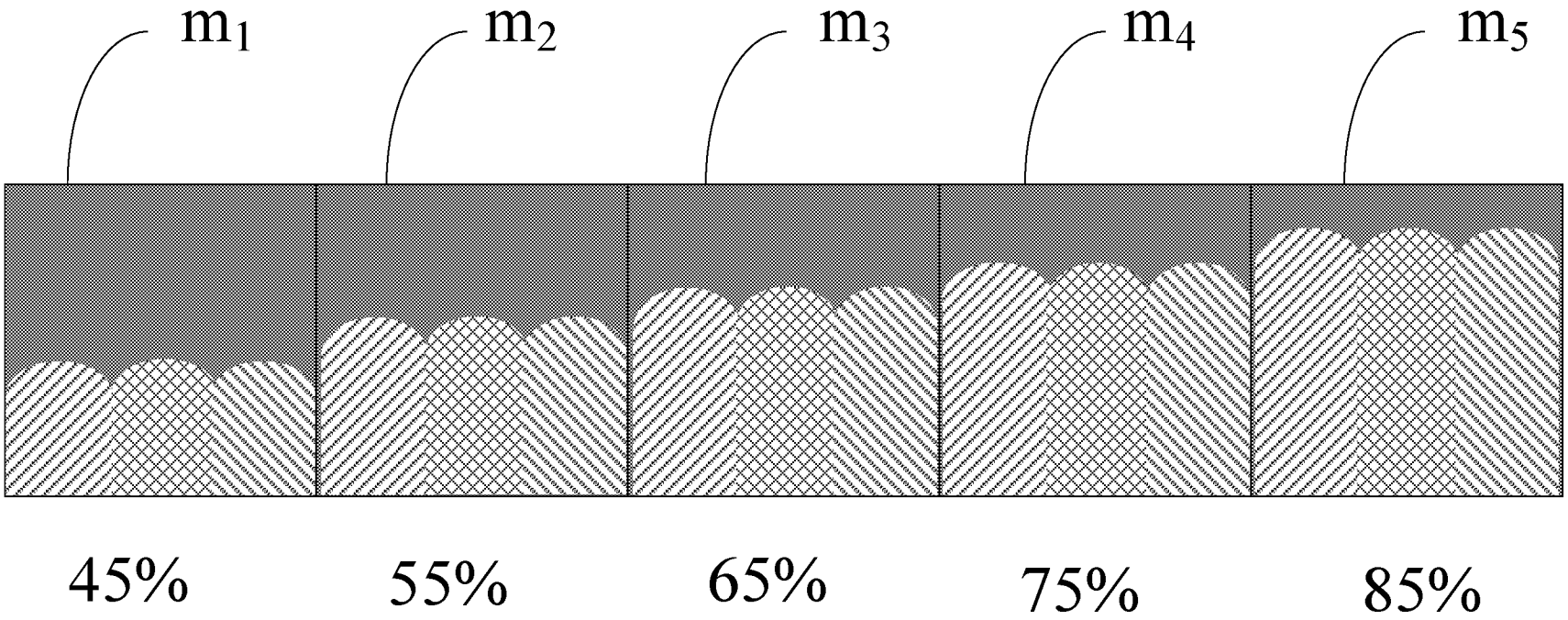
FIG. 11 is another enlarged schematic view of the area IV of FIG. 7.

FIG. 11 is another enlarged schematic view of a region IV of FIG. 7. As shown in FIG. 11, in the present embodiment, the unshielded pixel area ratios of the edge pixels m1, m2, m3, m4, and m5 are sequentially 45%, 55%, 65%, 75%, and 85%. Then, for two adjacent edge pixels, for example, the ratio of the shielding area S21 of the light shielding unit of the edge pixel m1 to the area SB of the edge pixel m1 is 55%. And the ratio of the shielding area S22 of the light shielding unit of the edge pixel m2 to the area SB of the edge pixel m2 is 45%, 55%-45%=10%, satisfying 10%≤|S21−S22|/SB≤30%.

In the pixel column direction, the difference in the shielding areas of the light shielding units of the two adjacent edge pixels in the first pixel group P1 satisfies the following conditions:

$$10\% \leq |S_{1c} - S_{1d}|/S_B \leq 30\%.$$

In the embodiment of the present disclosure, S1*c* and S1*d* are the shielding areas of the light shielding units of the two adjacent edge pixels in the first pixel group in the pixel column direction, respectively. In the pixel column direction, the difference of the shielding area S1 of the light shielding units between the adjacent edge pixels in the first pixel group is within a set range to ensure that the brightness difference of the edge pixels of the same row is not too large and realize a smooth brightness transition from bright in the display area A1 to dark in the non-display area A2 in the display panel.

Figure 12:
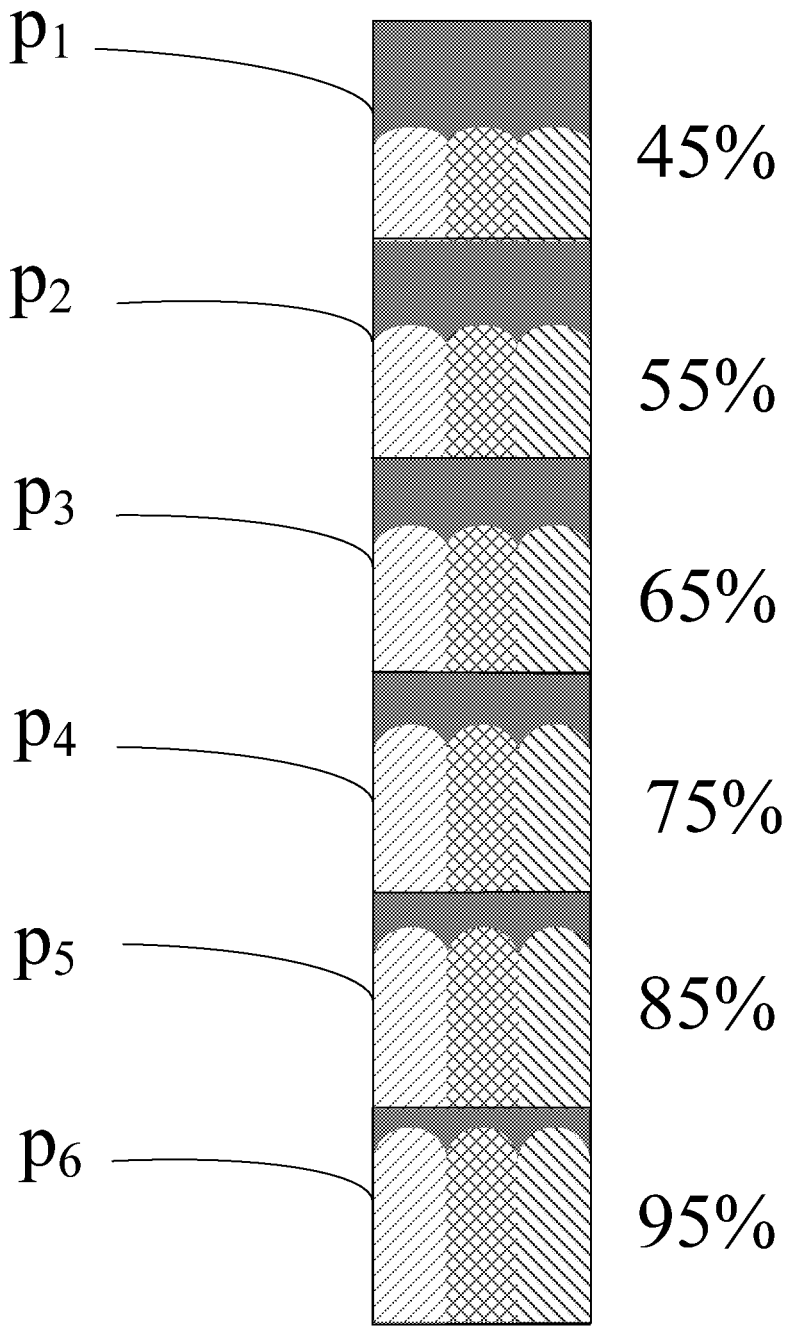
FIG. 12 is an enlarged schematic view of the region V of FIG. 8.

FIG. 12 is an enlarged schematic view of a region V of FIG. 8. As shown in FIGS. 12 and 8, in the p-th column pixel, the first pixel group P1 includes six edge pixels p1, p2, p3, p4, p5, and p6. Each edge pixel is provided with a light shielding unit and the percentage in FIG. 12 represents an unshielded pixel area ratio. The unshielded pixel area ratio represents a percentage ratio of a pixel area that is not shielded by the light shielding unit in each edge pixel to a total area of the edge pixel. In the present embodiment, the unshielded pixel area ratios of the edge pixels p1, p2, p3, p4, p5, and p6 are sequentially 45%, 55%, 65%, 75%, 85%, and 95%. Then, for two adjacent edge pixels, for example, the edge pixel p1 and the edge pixel p2, the ratio of the shielding area S11 of the light shielding unit of the edge pixel p1 to the area SB of the edge pixel p1 is 55%. The ratio of the shielding area S12 of the light shielding unit of the edge pixel p2 to the area SB of the edge pixel p2 is 45%, 55%-45%=10%, satisfying $10\% \leq |S11-S12|/SB \leq 30\%$.

Further, the display panel further includes a black matrix. In one implementation of the present disclosure, the light-shielding structure is the black matrix. The black matrix has a good shielding effect and is easy to implement. Since a black matrix for shielding is provided in a general display panel, when the above-mentioned irregularly shaped display panel is prepared, a light shielding structure can be directly formed when the black matrix is formed. The light shielding structure is formed along with the formation of the black matrix. Since both the black matrix and the light-shielding structure have a shielding function and no additional process is required to prepare the light shielding structure, it is advantageous to reduce the design difficulty of the display panel, without increasing the preparation process of the display panel, and improving the production efficiency.

In another implementation of the present disclosure, the light shielding structure may also be fabricated in the same layer with the opaque layer on the array substrate, for example, with the gate electrode, source and drain electrodes.

Further, the display panel includes an array substrate and a color filter substrate facing the array substrate and the black matrix is located on the color filter substrate.

In the embodiment of the present disclosure, as shown in FIG. 1, the boundary line of the profiled edge region A10 is an arc that is convex to the non-display area A2.

Figure 13:
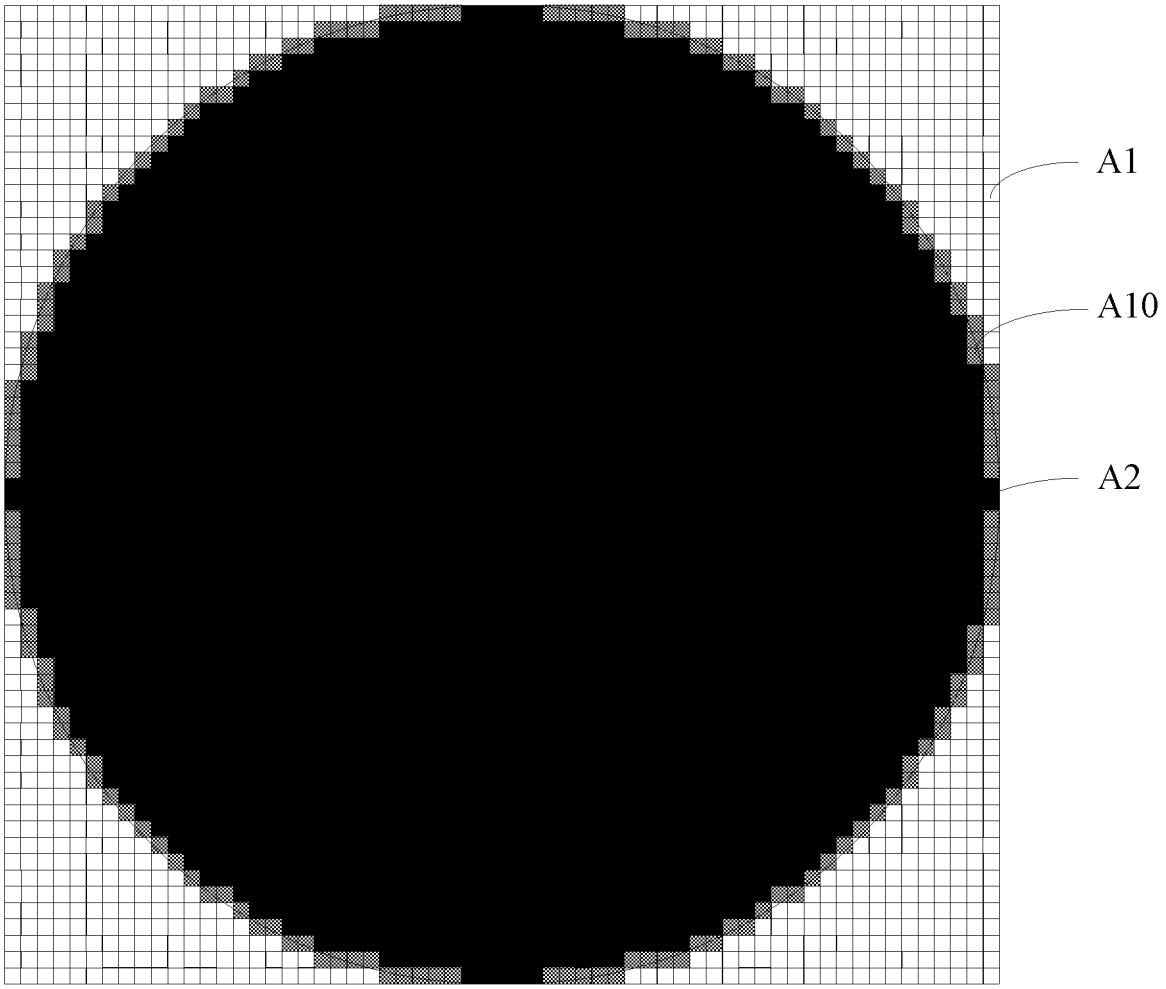
FIG. 13 is a schematic structural diagram of another display panel according to an embodiment of the present disclosure.

FIG. 13 is a schematic structural diagram of another display panel according to an embodiment of the present disclosure. As shown in FIG. 13, in the display panel, the circular area in the middle is the non-display area A2. The area surrounding the non-display area A2 is the display area A1. The boundary line of the profiled edge region A10 may also be an arc that is convex to the display area A1.

It should be noted that FIG. 1 and FIG. 13 respectively correspond to a filleted corner profiled edge and a rounded corner profiled edge display panel and the structures of FIGS. 1 and 13 are only an example. In other embodiments, the structures of FIG. 1 and FIG. 13 can also be only a half or a quarter, in which case the above scheme can still be used. Here, the filleted corner profiled edge is usually designed for the four corners of the display panel of a mobile terminal such as a mobile phone. The rounded corner profiled edge is usually designed for a region where the camera is set at the top of the display panel of a mobile terminal such as a mobile phone.

Figure 14:
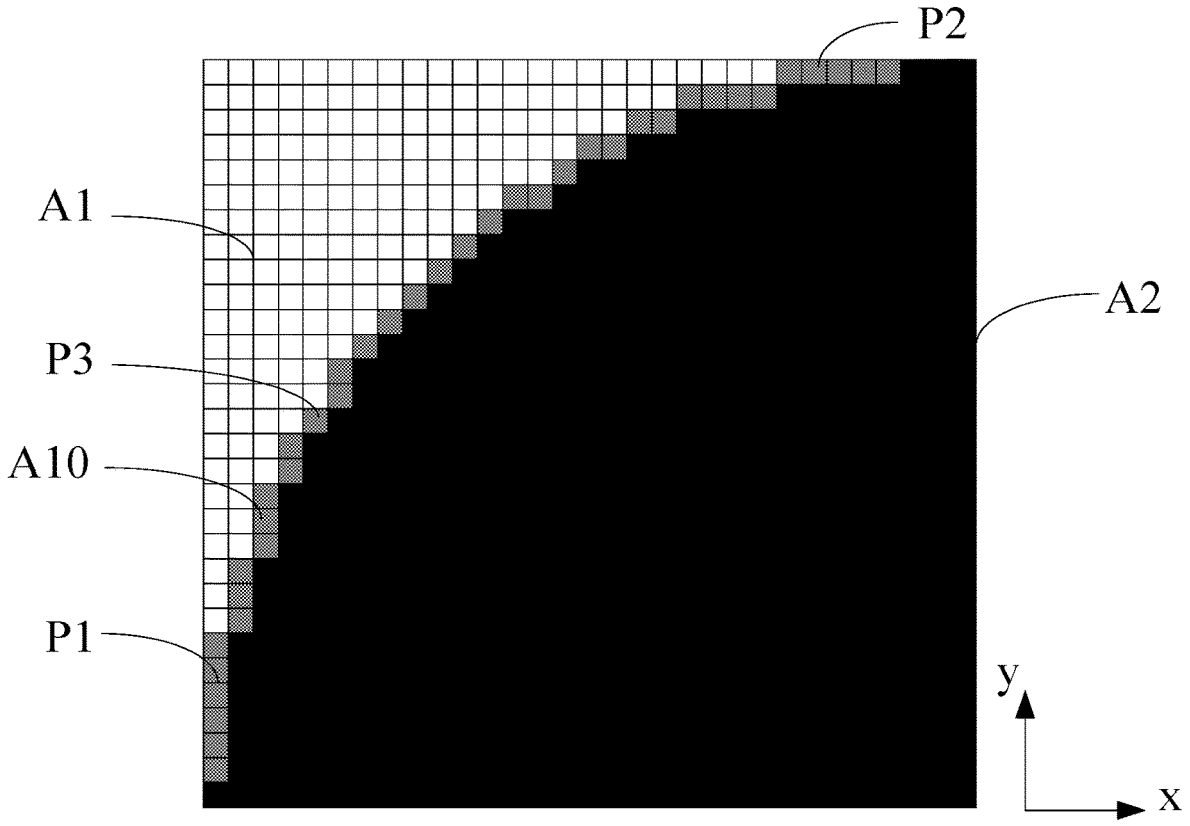
FIG. 14 is a partial enlarged view of FIG. 13.

FIG. 14 is a partially enlarged schematic view of FIG. 13. As shown in FIG. 14, the profiled edge region A10 includes a plurality of pixel groups arranged in a staircase manner. The plurality of pixel groups includes at least one of the first pixel group P1, the second pixel group P2, and the third pixel group P3. The first pixel group P1 includes at least two edge pixels set in the same pixel column along a pixel column direction (i.e., the y direction in FIG. 14). The second pixel group P2 includes at least two edge pixels set in the same pixel row along the pixel row direction (i.e., the x direction in FIG. 14). The third pixel group P3 includes one edge pixel.

The display panel further includes a light shielding structure (not shown in figure) set in the profiled edge region A10. And the light shielding structure includes light shielding units set in one-to-one correspondence with the edge pixels. Each light shielding unit is located on the light-emitting side of the corresponding edge pixel. In the pixel column direction, the shielding area S1 of the light shielding unit of the edge pixel in the first pixel group P1 decreases by equal difference in the direction away from the non-display area A2, where $0<S1<SB$. In the pixel row direction, the shielding area S2 of the light shielding unit of the edge pixel in the second pixel group P2 decreases by equal difference in the direction away from the non-display area A2, where $0<S2<SB$, and SB is the area of each edge pixel.

Further, in other embodiments, the display area may also be a sector, an arc, a circle, a rounded rectangle, or a polygon.

Figure 15:
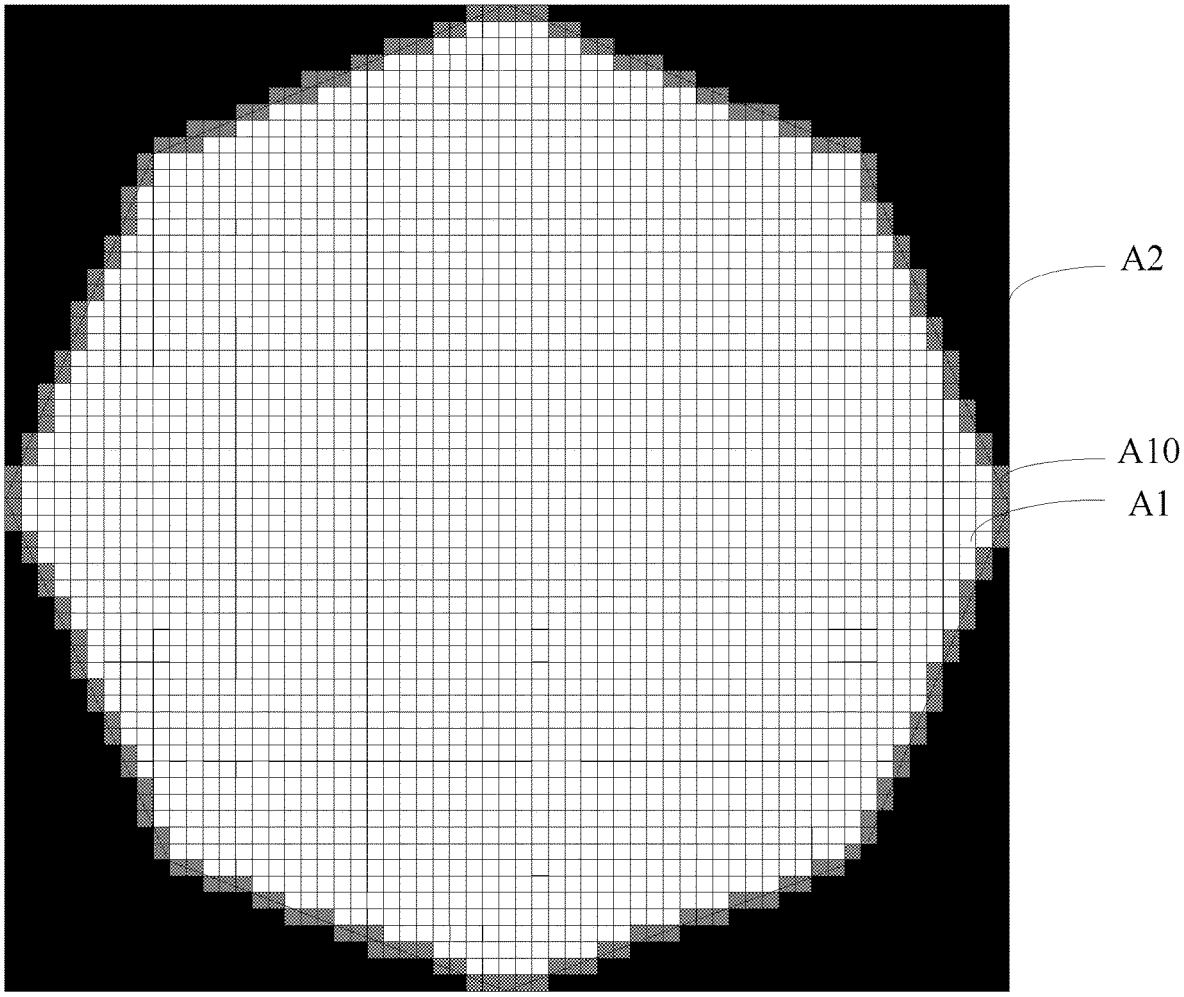
FIG. 15 is a schematic structural diagram of still another display panel according to an embodiment of the present disclosure.

FIG. 15 is a schematic structural diagram of another display panel according to an embodiment of the present disclosure. As shown in FIG. 15, the display area is an octagon at this time and the display panel includes a display area A1 and a non-display area A2 adjacent to the display area A1, in the embodiment shown in FIG. 15, the display area A1 includes eight profiled edge regions A10, and each profiled edge regions A10 corresponds to one side of the octagon, and the profiled edge region A10 includes a plurality of edge pixels.

Figure 16:
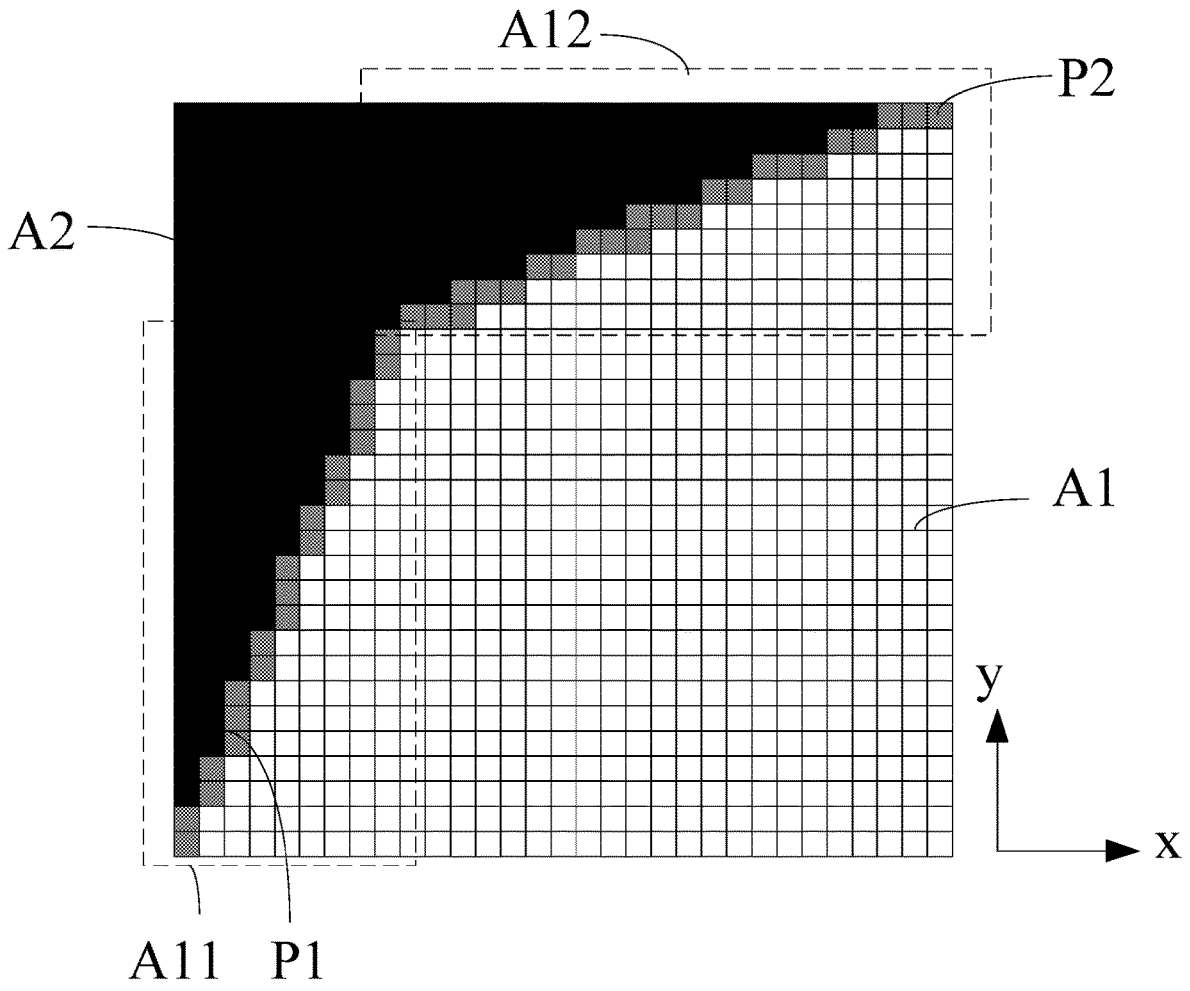
FIG. 16 is a partial enlarged view of FIG. 15.

FIG. 16 is a partial enlarged view of FIG. 15. As shown in FIG. 16, FIG. 16 includes a first profiled edge region A11 and a second profiled edge region A12 located in the upper left corner of FIG. 15. A plurality of edge pixels in the first profiled edge region A11 form a plurality of pixel groups arranged in a staircase manner. The plurality of pixel groups includes a first pixel group P1. The first pixel group P1 includes at least two edge pixels set in the same pixel column along the pixel column direction (i.e., the y direction in FIG. 16). The plurality of edge pixels in the second profiled edge region Alt constitutes a plurality of pixel groups arranged in a staircase manner. The plurality of pixel groups includes a second pixel group P2 and the second pixel group P2 includes at least two edge pixels set in the same pixel row along the pixel row direction i.e., x direction in FIG. 16).

In the embodiment shown in FIG. 16, the first profiled edge region A11 includes nine first pixel groups P1. The second profiled edge region A12 includes nine first pixel groups P2.

Figure 17:
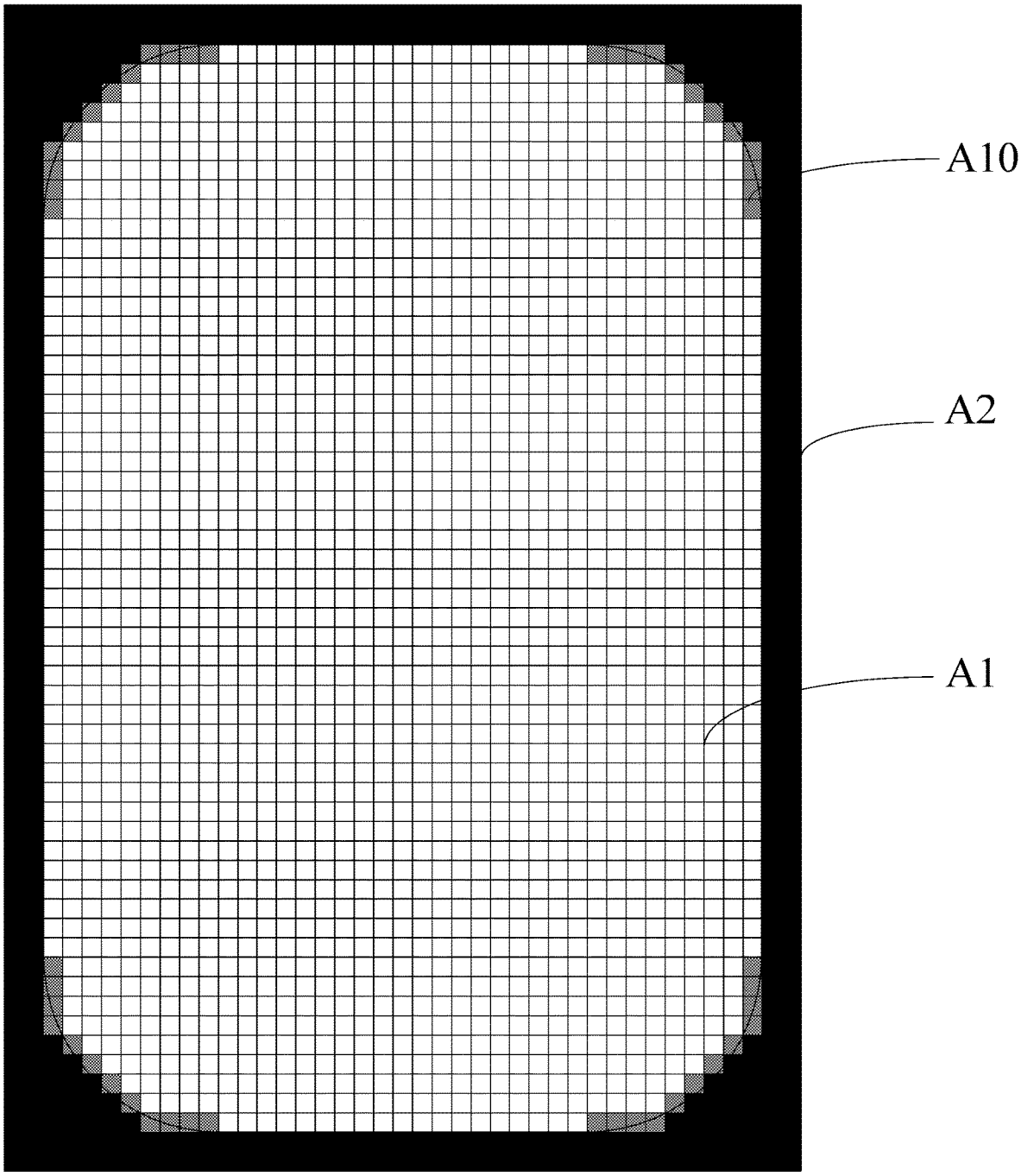
FIG. 17 is a schematic structural diagram of still display panel according to an embodiment of the present disclosure.

FIG. 17 is a schematic structural diagram of another display panel according to an embodiment of the present disclosure. As shown in FIG. 17, the display panel includes a display area A1 and a non-display area A2 adjacent to the display area A1. In the embodiment shown in FIG. 17, the display area A1 is a rounded rectangle, the display area A1 includes four profiled edge regions A10 located at the four corners of the display area A1. The profiled edge region A10 includes a plurality of edge pixels.

Figure 18:
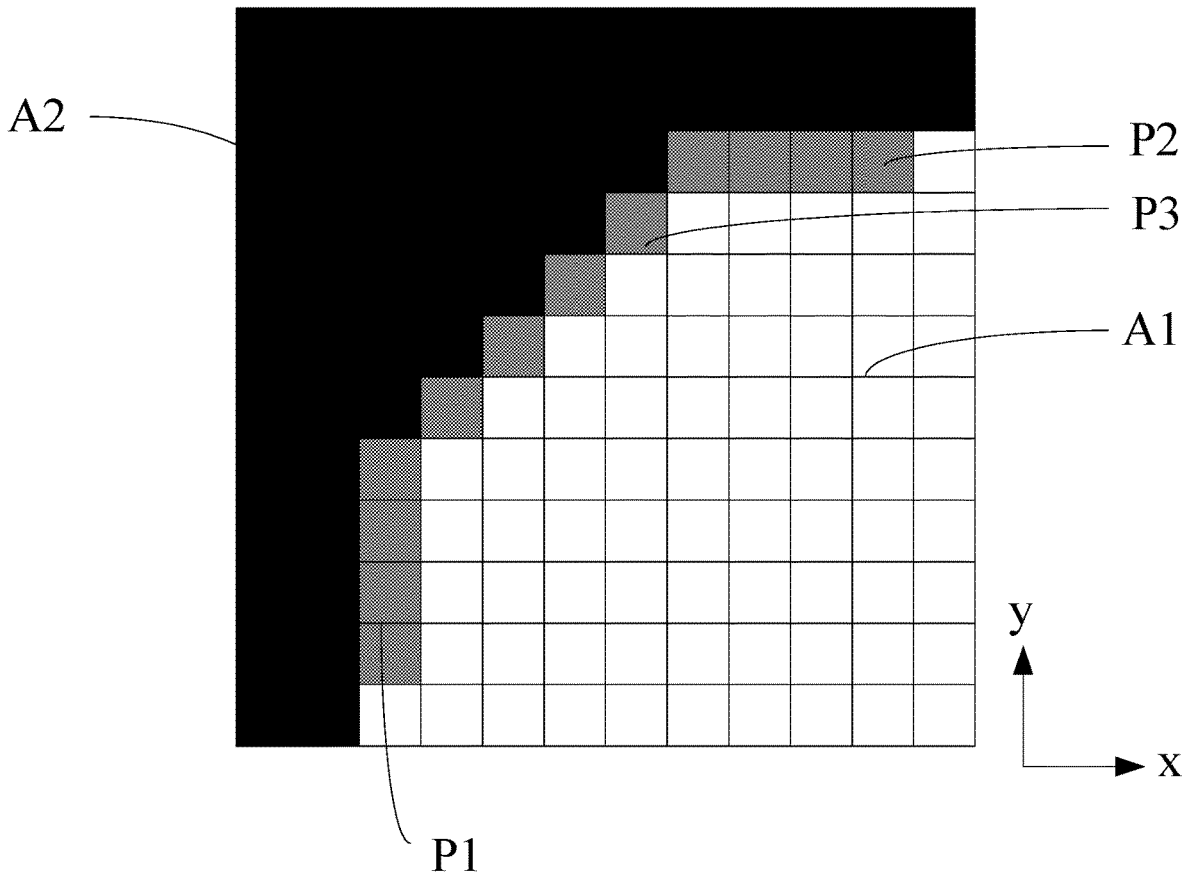
FIG. 18 is a partial enlarged view of FIG. 17.

FIG. 18 is a partially enlarged schematic view of FIG. 17. As shown in FIG. 18, FIG. 18 includes a profiled edge region A10 located at the upper left corner of FIG. 17. A plurality of edge pixels in the profiled edge region A10 constitutes a plurality of pixel groups arranged in a staircase manner. The plurality of pixel groups includes at least one of a pixel group P1, a second pixel group P2, and a third pixel group P3. The first pixel group P1 includes at least two edge pixels set in the same pixel column along the pixel column direction (i.e., the y direction in FIG. 18). The second pixel group P2 includes at least two edge pixels set in the same pixel row along the pixel row direction (i.e., the x direction in FIG. 18). The third pixel group P3 includes one edge pixel.

In the embodiment shown in FIG. 18, the profiled edge region A10 includes one first pixel group P1, one first pixel group P2, and four first pixel groups P3.

Embodiments of the present disclosure also provide a display device including the display panel as shown in FIG. 1, FIG. 13, FIG. 15, or FIG. 17.

In the embodiment of the present disclosure, the display device provided by the embodiment of the present disclosure may be any product or component having a display function, such as a mobile phone, a tablet computer, a television, a display, a notebook computer, a digital photo frame, a navigator, and the like.

In the embodiment of the present disclosure, a light shielding structure is set in a profiled edge region of the display panel. The light shielding structure includes light shielding units set in one-to-one correspondence with the edge pixels. Each edge pixel includes a plurality of sub-pixels. The shielding area of the light shielding unit on the plurality of sub-pixels of the same edge pixel is equal, that is, in the same edge pixel, the light-emitting area of each sub-pixel is equal, which can prevent the color-shift phenomenon from happening in the pixel. Meanwhile, the orthographic projection of the light shielding unit on each sub-pixel covers an end of the corresponding sub-pixel adjacent to the non-display area in the pixel column direction. The boundary line between the orthographic projection and the corresponding sub-pixel is an arc that is concave to the non-display area. That is, one end of each sub-pixel adjacent to the non-display area in the pixel column direction is a convex arc, for example, a semicircle. The arcuate design can make the weakening effect of the saw tooth at the profiled edge region more obvious, reduces the edge saw tooth effect of the display panel, and improves the display effect of the irregularly-shaped display panel, so that the saw teeth of the profiled edge region which can be perceived by human eyes are no longer obvious.

Figure 19:
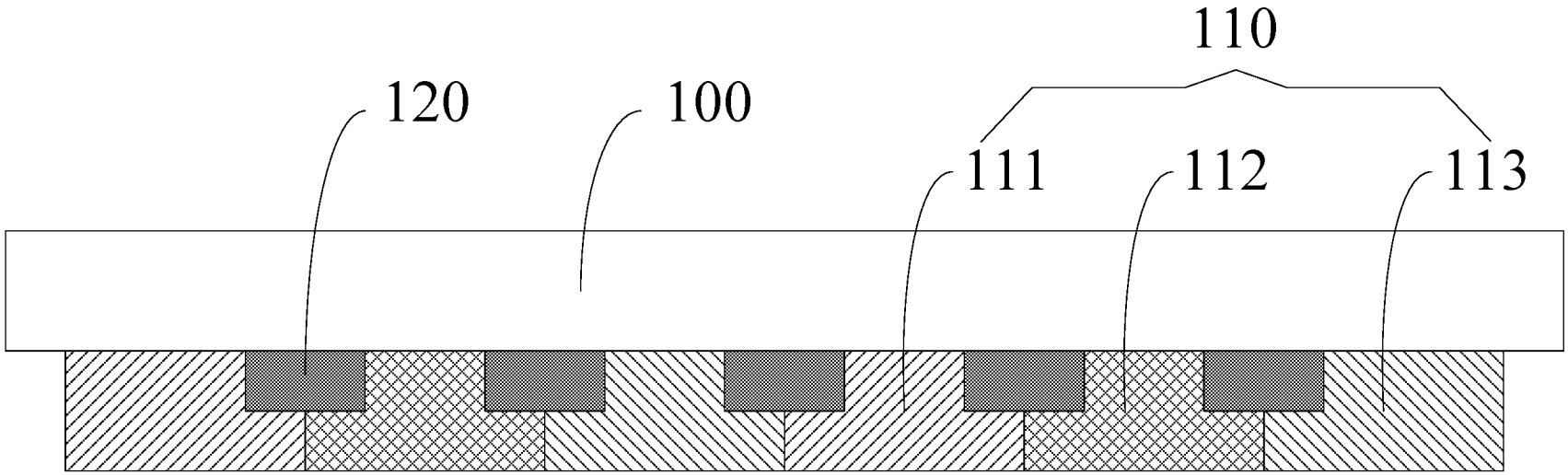
FIG. 19 is a schematic structural diagram of a color filter substrate according to an embodiment of the present disclosure.

The embodiment of the present disclosure further provides a color filter substrate and FIG. 19 is a schematic structural diagram of a color filter substrate according to an embodiment of the present disclosure. As shown in FIG. 19, the color filter substrate usually includes a base substrate 100 and a color filter layer 110 and a black matrix 120 formed on the base substrate 100. The light transmitting region of the black matrix 120 is filled with the color filter layer 110. The light emitted from the sub-pixel has a color after passing through the light-transmitting region of the color filter layer 110. In the embodiment of the present disclosure, the color filter layer 110 is made of a color resist material, and may include, for example, a red color block 111, a green color block 112, and a blue color block 113.

Figure 20:
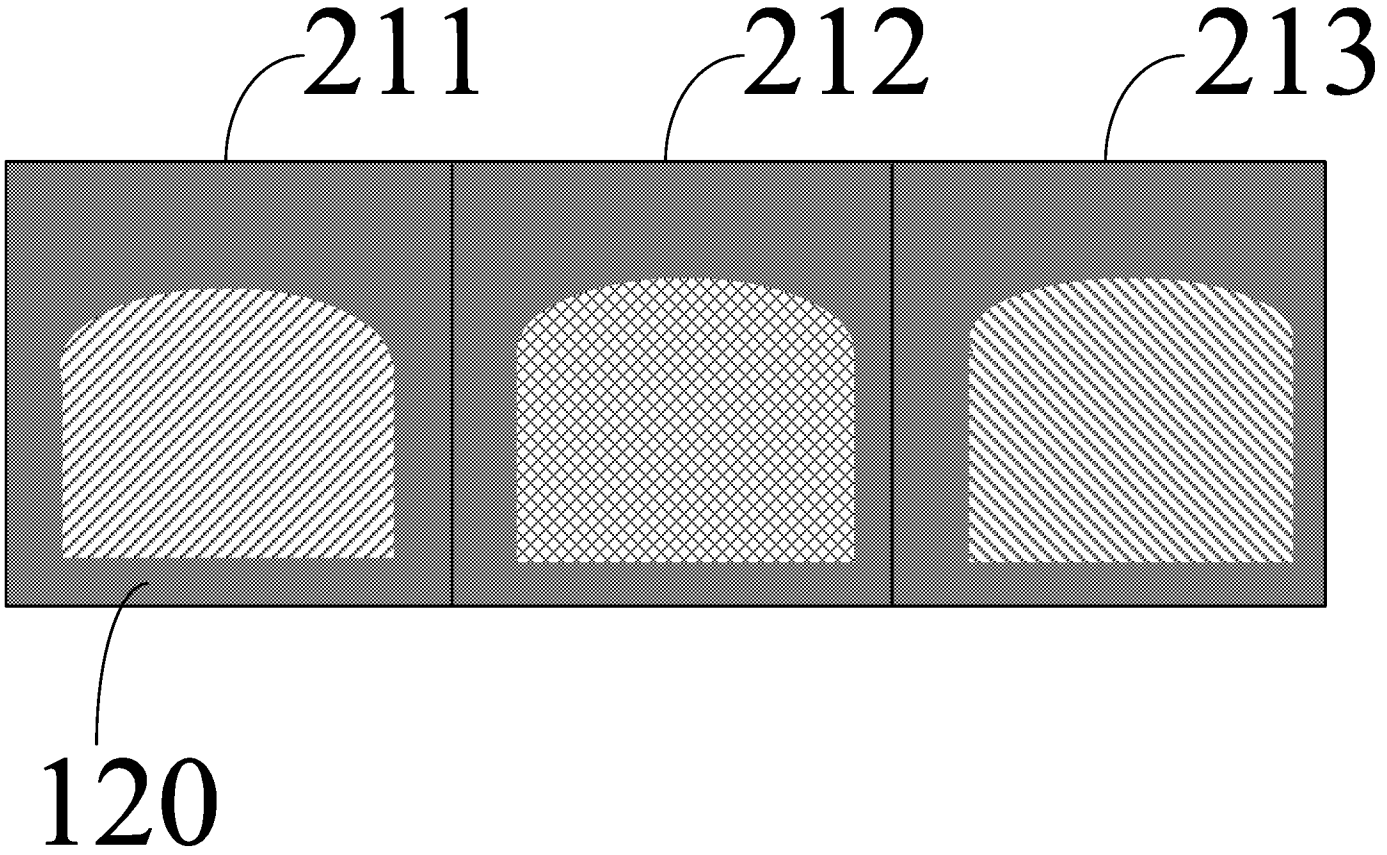
FIG. 20 is a schematic structural diagram of a partial edge pixel region of a color filter substrate according to an embodiment of the present disclosure.

FIG. 20 is a schematic structural diagram of a partial edge pixel region of a color filter substrate according to an embodiment of the present disclosure. As shown in FIG. 20, each edge pixel region includes three sub-pixel regions of a red sub-pixel region 211, a green sub-pixel region 212, and a blue sub-pixel region 213. The color filter layer corresponding to the red sub-pixel region 211 is made of a red color block 111. The color filter layer corresponding to the green sub-pixel region 212 is made of the green color block 112, and the color filter layer corresponding to the blue sub-pixel region 213 is made of the blue color block 113.

Corresponding to the display panel structure of FIG. 1, the color filter substrate includes a display area (corresponding to A1 in FIG. 1) and a non-display area (corresponding to A2 in FIG. 1). The display area includes at least one profiled edge region (corresponding to A10 in FIG. 1). Each profiled edge region includes a plurality of edge pixel regions. The display panel further includes a light shielding structure set on the profiled edge region. The light shielding structure includes light shielding units set in one-to-one correspondence with the edge pixel regions.

In this embodiment, the light shielding structure is a black matrix. The black matrix has the same shielding area on the three sub-pixel regions of the same edge pixel region. In the pixel column direction, the orthographic projection of the black matrix on each sub-pixel region covers one end of the corresponding sub-pixel region close to the non-display area in the pixel column direction. The boundary line between the orthographic projection and the corresponding sub-pixel region is an arc concave to the non-display area.

Further, a plurality of edge pixel regions constitutes a plurality of pixel region groups arranged in a staircase manner, that is, the profiled edge regions include a plurality of pixel region groups arranged in a staircase manner. The plurality of pixel region groups includes at least one of a first pixel region group, a second pixel region group, and a third pixel region group.

The first pixel region group includes at least two edge pixel regions set in the same pixel region column in the pixel column direction, that is, a region corresponds to the first pixel group P1 in the embodiment shown in FIG. 6. The second pixel region group includes at least two edge pixel regions set in the same pixel region row in the pixel row direction, that is, a region corresponds to the second pixel group P2 in the embodiment shown in FIG. 6. The third pixel region group includes one edge pixel region, that is, a region corresponds to the third pixel group P3 in the embodiment shown in FIG. 6.

In the pixel column direction, the shielding area S1 of the light shielding unit of the edge pixel region in the first pixel region group decreases by an equal difference in the direction away from the non-display area, $0<S1<SB$. Referring to related descriptions of the light shielding unit of the edge pixel region in the first pixel region group in the embodiment shown in FIG. 7, FIG. 9, FIG. 10 and FIG. 11.

In the pixel row direction, the shielding area S2 of the light shielding unit of the edge pixel region in the second pixel region group decreases by an equal difference in the direction away from the non-display area, where $0<S_2<S_B$, and $S_B$ is the area of each edge pixel region. Referring to the related description of the light shielding unit in the edge pixel region in the second pixel region group in the embodiment shown in FIG. 8 and FIG. 12.

In the embodiment of the present disclosure, a light shielding structure is set on a profiled edge region of the color filter substrate. The light shielding structure includes light shielding units set in one-to-one correspondence with the edge pixels. Each edge pixel region includes a plurality of sub-pixel regions. The shielding areas of the light shielding units on a plurality of sub-pixel regions of the same edge pixel region are equal, that is, in the same edge pixel region, the light-emitting area of each sub-pixel region is equal, which can prevent color shift phenomenon from happening in pixels. Meanwhile, the orthographic projection of the light shielding unit on each sub-pixel region covers one end of the corresponding sub-pixel region in the pixel column direction close to the non-display area. The boundary line between the orthographic projection and the corresponding sub-pixel region is an arc that is concave to the non-display area, that is, an end of each sub-pixel region that is close to the non-display area in the pixel column direction is a convex arc, for example, a semicircle. The arcuate design can make weakening effect of the saw tooth of the profiled edge region more obvious, reduce the saw tooth effect of the edge of the color filter substrate, and improve the display effect of the color filter substrate. Thus, the saw teeth of the profiled edge region which can be perceived by human eyes are no longer obvious.

The foregoing descriptions are merely exemplary embodiments of the present disclosure and are not intended to limit the present disclosure. Within the spirit and principles of the disclosure, any modifications, equivalent substitutions, improvements, etc., are within the protection scope of the appended claims of the present disclosure.

What is claimed is:

1. A display panel, comprising: a display area and a non-display area adjacent to the display area, wherein the display area comprises at least one profiled edge region, each profiled edge region comprises a plurality of edge pixels, the display panel further comprises a light shielding structure in the profiled edge region, and the light shielding structure comprises light shielding units in one-to-one correspondence to the edge pixels;

at least one of the edge pixels comprises a plurality of sub-pixels arranged side by side in a first direction, an orthographic projection of the light shielding unit on each sub-pixel covers a first end of a corresponding sub-pixel, the first end is an end close to the non-display area in a second direction, a first boundary line between the orthographic projection of the light shielding unit on one sub-pixel and the corresponding sub-pixel is an arc, and the second direction is perpendicular to the first direction, wherein a concave direction of the first boundary line is the same as a concave direction of a second boundary line of the display area where the profiled edge region is located; in a case that the second boundary line is a convex arc portion, the first boundary line is concave toward the non-display area along the second direction; and in a case that the second boundary line is a concave arc portion, the first boundary line is concave toward the display area along the second direction, wherein the profiled edge region comprises a plurality of pixel groups arranged in a staircase manner, and the plurality of pixel groups comprise at least one of a first pixel group, a second pixel group, and a third pixel group;

the first pixel group comprises at least two edge pixels in the same pixel column, the second pixel group comprises at least two edge pixels in the same pixel row, and the third pixel group comprises one edge pixel;

in a pixel column direction, a shielding area S1 of the light shielding unit of the edge pixel in the first pixel group decrease by equal difference in a direction away from the non-display area, where 0<S1<SB, and in a pixel row direction, a shielding area S2 of the light shielding unit of the edge pixel in the second pixel group decreases by equal difference in a direction away from the non-display area, where 0<S2<SB, and SB is the area of each edge pixel, and wherein a difference in a shielding area of the light shielding unit of the outermost pixel of the two adjacent pixel groups among the plurality of pixel groups satisfies the following condition;

$$10\% \leq |S_m - S_n| / S_B \leq 30\%;$$

wherein $S_m$ and $S_n$ are shielding areas of the light shielding units of the outermost pixels of the two adjacent pixel groups of the plurality of pixel groups respectively, the outermost pixel of the first pixel group is the edge pixel closest to the non-display area in the pixel column direction, the outermost pixel of the second pixel group is the edge pixel closest to the non-display area in the pixel row direction, and the one edge pixel of the third pixel group is the outermost pixel.

2. The display panel according to claim 1, wherein the first boundary line is concave to the non-display area along the second direction.

3. The display panel according to claim 1, wherein, in the pixel row direction, a shielding area of the light shielding unit of two adjacent edge pixels in the second pixel group satisfies the following condition:

$$10\% \leq |S_{2a} - S_{2b}| / S_B \leq 30\%;$$

wherein $S_{2a}$ and $S_{2b}$ are shielding areas of the light shielding units of two adjacent edge pixels in the second pixel group in the pixel row direction, respectively.

4. The display panel according to claim 1, wherein, in the pixel column direction, a shielding area of the light shielding unit of two adjacent edge pixels in the first pixel group satisfies the following condition:

$$10\% \leq |S_{1c} - S_{1d}| / S_B \leq 30\%;$$

wherein $S_{1c}$ and $S_{1d}$ are shielding areas of the light shielding units of the two adjacent edge pixels in the first pixel group in the pixel column direction; respectively.

5. The display panel according to claim 1, wherein the light shielding structure is a black matrix.

6. The display panel according to claim 5, wherein the display panel comprises an array substrate and a color filter substrate facing the array substrate, and the black matrix is located on the color filter substrate.

7. The display panel according to claim 1, wherein a boundary line of the profiled edge region is an arc convex to the non-display area or an arc convex to the display area.

8. The display panel according to claim 1, wherein the display area is a sector, an arc, a circle, a rounded rectangle, or a polygon.

9. The display panel according to claim 1, wherein the light shielding unit has the same shielding area on the plurality of sub-pixels in the same edge pixel.

10. The display device according to claim 1, wherein, in the pixel row direction, a shielding area of the light shielding unit of two adjacent edge pixels in the second pixel group satisfies the following condition:

$$10\% \leq |S_{2a} - S_{2b}| / S_B \leq 30\%;$$

wherein $S_{2a}$ and $S_{2b}$ are shielding areas of the light shielding units of two adjacent edge pixels in the second pixel group in the pixel row direction, respectively.

11. The display panel according to claim 1, wherein, in the pixel column direction, a shielding area of the light shielding unit of two adjacent edge pixels in the first pixel group satisfies the following condition:

$$10\% \leq |S_{1c}-S_{1d}|/S_B \leq 30\%;$$

wherein $S_{1c}$ and $S_{1d}$ are shielding areas of the light shielding units of the two adjacent edge pixels in the first pixel group in the pixel column direction, respectively.

12. A display device, comprising a display panel, wherein the display panel comprises: a display area and a non-display area adjacent to the display area, wherein the display area comprises at least one profiled edge region, each profiled edge region comprises a plurality of edge pixels, the display panel further comprises a light shielding structure in the profiled edge region, and the light shielding structure comprises light shielding units in one-to-one correspondence to the edge pixels;

at least one of the edge pixels comprises a plurality of sub-pixels arranged side by side in a first direction, an orthographic projection of the light shielding unit on each sub-pixel covers a first end of a corresponding sub-pixel, the first end is an end close to the non-display area in a second direction, a first boundary line between the orthographic projection of the light shielding unit on one sub-pixel and the corresponding sub-pixel is an arc, and the second direction is perpendicular to the first direction, wherein a concave direction of the first boundary line is the same as a concave direction of a second boundary line of the display area where the profiled edge region is located; in a case that the second boundary line is a convex arc portion, the first boundary line is concave toward the non-display area along the second direction; and in a case that the second boundary line is a concave arc portion, the first boundary line is concave toward the display area along the second direction, wherein the profiled edge region comprises a plurality of pixel groups arranged in a staircase manner, and the plurality of pixel groups comprise at least one of a first pixel group, a second pixel group, and a third pixel group;

the first pixel group comprises at least two edge pixels in the same pixel column, the second pixel group comprises at least two edge pixels in the same pixel row, and the third pixel group comprises one edge pixel;

in a pixel column direction, a shielding area S1 of the light shielding unit of the edge pixel in the first pixel group decrease by equal difference in a direction away from the non-display area, where 0<S1<SB, and in a pixel row direction, a shielding area S2 of the light shielding unit of the edge pixel in the second pixel group decreases by equal difference in a direction away from the non-display area, where 0<S2<SB, and SB is the area of each edge pixel, and wherein a difference in a shielding area of the light shielding unit of the outermost pixel of the two adjacent pixel groups among the plurality of pixel groups satisfies the following condition:

$$10\% \leq |S_m-S_n|/S_B \leq 30\%;$$

wherein $S_m$ and $S_n$ are shielding areas of the light shielding units of the outermost pixels of the two adjacent pixel groups of the plurality of pixel groups respectively, the outermost pixel of the first pixel group is the edge pixel closest to the non-display area in the pixel column direction, the outermost pixel of the second pixel group is the edge pixel closest to the non-display area in the pixel row direction, and the one edge pixel of the third pixel group is the outermost pixel.

13. The display device according to claim 12, wherein the first boundary line is concave to the non-display area along the second direction.

14. A color filter substrate, comprising: a display area and a non-display area adjacent to the display area, wherein the display area comprises at least one profiled edge region, each profiled edge region comprises a plurality of edge pixel regions, the color filter substrate further comprises a light shielding structure of the profiled edge region, and the light shielding structure comprises light shielding units in one-to-one correspondence to the edge pixel regions;

at least one of the edge pixel regions comprises a plurality of sub-pixel regions arranged side by side in a first direction, and an orthographic projection of the light shielding unit on each sub-pixel region covers a first end of a corresponding sub-pixel region, the first end is an end close to the non-display area in the second direction, a first boundary line between the orthographic projection of the light shielding unit on one sub-pixel region and the corresponding sub-pixel region is an arc, and the second direction is perpendicular to the first direction, wherein a concave direction of the first boundary line is the same as a concave direction of a second boundary line of the display area where the profiled edge region is located; in a case that the second boundary line is a convex arc portion, the first boundary line is concave toward the non-display area along the second direction; and in a case that the second boundary line is a concave arc portion, the first boundary line is concave toward the display area along the second direction, wherein the profiled edge region comprises a plurality of pixel groups arranged in a staircase manner, and the plurality of pixel groups comprise at least one of a first pixel group, a second pixel group, and a third pixel group;

the first pixel group comprises at least two edge pixels in the same pixel column the second pixel group comprises at least two edge pixels in the same pixel row, and the third pixel group comprises one edge pixel;

in a pixel column direction, a shielding area S1 of the light shielding unit of the edge pixel in the first pixel group decrease by equal difference in a direction away from the non-display area, where 0<S1<SB, and in a pixel row direction, a shielding area S2 of the light shielding unit of the edge pixel in the second pixel group decreases by equal difference in a direction away from the non-display area, where 0<S2<SB, and SB is the area of each edge pixel, and wherein a difference in a shielding area of the light shielding unit of the outermost pixel of the two adjacent pixel groups among the plurality of pixel groups satisfies the following condition:

$$10\% \leq |S_m-S_n|/S_B \leq 30\%;$$

wherein $S_m$ and $S_n$ are shielding areas of the light shielding units of the outermost pixels of the two adjacent pixel groups of the plurality of pixel groups respectively, the outermost pixel of the first pixel group is the edge pixel closest to the non-display area in the pixel column direction, the outermost pixel of the second pixel group is the edge pixel closest to the non-display area in the pixel row direction, and the one edge pixel of the third pixel group is the outermost pixel.

15. The color filter substrate according to claim 14, wherein the first boundary line is concave to the non-display region in the second direction.

* * * * *